US008220425B2

(12) United States Patent
Kumagai et al.

(10) Patent No.: US 8,220,425 B2
(45) Date of Patent: Jul. 17, 2012

(54) VALVE OPERATION CONTROL SYSTEM FOR INTERNAL COMBUSTION ENGINE

(75) Inventors: Kazuhide Kumagai, Wako (JP); Tomonori Niizato, Wako (JP); Masataka Ikawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 332 days.

(21) Appl. No.: 12/670,554

(22) PCT Filed: Aug. 12, 2008

(86) PCT No.: PCT/JP2008/064463

§ 371 (c)(1),
(2), (4) Date: Jan. 25, 2010

(87) PCT Pub. No.: WO2009/025205

PCT Pub. Date: Feb. 26, 2009

(65) Prior Publication Data

US 2010/0186692 A1 Jul. 29, 2010

(30) Foreign Application Priority Data

Aug. 23, 2007 (JP) ..... 2007-217101
Aug. 23, 2007 (JP) ..... 2007-217102

(51) Int. Cl.
*F01L 9/02* (2006.01)

(52) U.S. Cl. ..... 123/90.12; 123/90.16; 137/625.5

(58) Field of Classification Search ..... 123/90.12, 123/90.16; 251/129.15; 137/625.5, 625.6
See application file for complete search history.

(56) References Cited

U.S. PATENT DOCUMENTS

| | | | | |
|---|---|---|---|---|
| 5,537,963 | A | 7/1996 | Hasebe | |
| 2002/0059911 | A1 | 5/2002 | Takahashi et al. | |
| 2003/0101949 | A1 * | 6/2003 | Uchida | 123/90.12 |

FOREIGN PATENT DOCUMENTS

| | | | |
|---|---|---|---|
| EP | 0 259 106 | A1 | 3/1988 |
| EP | 0 639 694 | A1 | 2/1995 |
| EP | 1 046 793 | A2 | 10/2000 |
| EP | 1 201 884 | A2 | 5/2002 |
| EP | 1 333 159 | A2 | 8/2003 |
| EP | 1 548 240 | A1 | 6/2005 |
| JP | 64-49606 | U | 3/1989 |

(Continued)

*Primary Examiner* — Zelalem Eshete
(74) *Attorney, Agent, or Firm* — Arent Fox LLP

(57) ABSTRACT

A valve operation control system for an internal combustion engine in which hydraulic pressure applied to a valve operation mode changing mechanism is controlled by hydraulic pressure control means that is formed from a holder mounted on a cylinder head, a spool valve formed by slidably housing a spool valve body in a valve body, and an electromagnetic open/close valve for controlling hydraulic pressure of a pilot hydraulic chamber, wherein the holder (109) is formed by integrally connecting a housed portion (109*a*) and a projecting portion (109*b*) by means of a connection portion (109*c*), the housed portion (109*a*) being housed between the cylinder head (22R) and a head cover, the projecting portion (109*b*) projecting outside the cylinder head (22R) and the head cover and having the electromagnetic open/close valve (113, 114) mounted thereon, a seal face (116) with the head cover is formed on the connection portion (109*c*), and the valve body (110) is provided so as to be connected to the housed portion (109*a*) while being housed between the head cover and the cylinder head (22R). This enables the sealing properties between the holder and the head cover to be enhanced.

8 Claims, 18 Drawing Sheets

FOREIGN PATENT DOCUMENTS

| | | | |
|---|---|---|---|
| JP | 7-259524 | A | 10/1995 |
| JP | 11-247627 | A | 9/1999 |
| JP | 2001-227312 | A | 8/2001 |
| JP | 2002-155718 | A | 5/2002 |
| JP | 2006-200390 | A | 8/2006 |

* cited by examiner

VALVE OPERATION CONTROL SYSTEM FOR INTERNAL COMBUSTION ENGINE

TECHNICAL FIELD

Cross-Referenced to Related Application

This application is a National Stage entry of International Application No. PCT/JP2008/064463, filed Aug. 12, 2008, which claims priority to Japanese Patent Application No. 2007-217101, filed Aug. 23, 2007, and Japanese Patent Application No. 2007-217102, filed Aug. 23, 2007, the disclosure of the prior applications is incorporated in its entirety by reference.

The present invention relates to a valve operation control system for an internal combustion engine that includes a hydraulic valve operation mode changing mechanism that switches the operation mode of an engine valve openably and closably disposed in a cylinder head and hydraulic pressure control means for controlling hydraulic pressure that is applied to the valve operation mode changing mechanism.

BACKGROUND ART

A valve operation control system for an internal combustion engine in which hydraulic pressure applied to a valve operation mode changing mechanism is controlled by hydraulic pressure control means formed from a holder mounted on a cylinder head, a spool valve formed by slidably housing in a valve body connected to the holder a spool valve body having one end part facing a pilot hydraulic chamber, and an electromagnetic open/close valve for controlling the hydraulic pressure of the pilot hydraulic chamber is already well known from, for example, Patent Publication 1, etc.

Patent Publication 1: Japanese Patent Application Laid-open No. 2002-155718

DISCLOSURE OF INVENTION

Problems to be Solved by the Invention

However, the valve operation control system disclosed in Patent Publication 1 above is arranged such that the valve body is joined to one end of the holder mounted on the cylinder head so as to project outward from the cylinder head and a head cover, the electromagnetic open/close valve is mounted on the valve body, and a seal face with the head cover is formed on one part of the outer periphery of the one end of the holder. Because of this, an oil passage connecting the spool valve and the holder and an oil passage connecting the electromagnetic open/close valve and the holder are provided between the holder and the valve body, and it is necessary to set the cross-sectional area of the holder in a portion in which the seal face is formed so as to be relatively large in order to arrange the relatively large number of oil passages, thus causing problems with the sealing properties of the seal face.

The present invention has been accomplished in the light of such circumstances, and it is a first object thereof to provide a valve operation control system for an internal combustion engine that enables the sealing properties between a holder and a head cover to be easily enhanced.

For example, in order to make a plurality of types of combinations possible for operation modes of engine valves of a plurality of cylinders, the number of oil passages for which hydraulic pressure is controlled by hydraulic pressure control means is sometimes increased, and in such a case providing a large number of output ports in a single spool valve or controlling the hydraulic pressures of the oil passages by a plurality of spool valves could be considered. However, when a single spool valve is employed, the spool valve itself increases in size, and not only does machining become complicated, but formation of the oil passages also becomes complicated. Furthermore, when a plurality of spool valves are used there is the problem that the size is increased in order to avoid interference between the additional oil passages.

The present invention has been accomplished in the light of such circumstances, and it is a second object thereof to provide a valve operation control system for an internal combustion engine that, using a pair of spool valves, can avoid any increase in size while simplifying machining and oil passage formation.

Means for Solving the Problems

In order to attain the above first object, according to a first aspect of the present invention, there is provided a valve operation control system for an internal combustion engine comprising a hydraulic valve operation mode changing mechanism for switching the operation mode of an engine valve openably and closably disposed in a cylinder head, and hydraulic pressure control means for controlling hydraulic pressure that is applied to the valve operation mode changing mechanism, the hydraulic pressure control means comprising a holder mounted on the cylinder head, a spool valve formed by slidably housing a spool valve body in a valve body provided so as to be connected to the holder, the spool valve body having one end part facing a pilot hydraulic chamber, and an electromagnetic open/close valve for controlling hydraulic pressure of the pilot hydraulic chamber, characterized in that the holder is formed by integrally connecting a housed portion and a projecting portion by means of a connection portion, the housed portion being housed between the cylinder head and a head cover secured to the cylinder head, the projecting portion projecting outside the cylinder head and the head cover and having the electromagnetic open/close valve mounted thereon, a seal face between the head cover and the cylinder head is formed on the connection portion, and the valve body is provided so as to be connected to the housed portion while being housed between the head cover and the cylinder head.

According to a second aspect of the present invention, in addition to the first aspect, the housed portion of the holder is secured to the cylinder head at two mutually spaced positions, a joining face of the valve body by which the valve body is joined to the housed portion is set so as to be parallel to a joining face of the holder by which the holder is joined to the cylinder head, the valve body being formed as a separate body from the holder, and the joining face is disposed between the two positions via which the housed portion is secured to the cylinder head.

According to a third aspect of the present invention, in addition to the first or second aspect, the spool valve bodies of a pair of the spool valves are slidably housed in the valve body so as to have mutually parallel axes in a direction perpendicular to a cylinder arrangement direction of a plurality of cylinders disposed in-line.

According to a fourth aspect of the present invention, in addition to the third aspect, the spool valve bodies of the two spool valves are slidably housed in the valve body so that the pilot hydraulic chambers, which end parts of the spool valve bodies respectively face, are close to each other and moving directions when hydraulic pressure is applied to the two pilot hydraulic chambers are opposite to each other.

In order to attain the above second object, according to a fifth aspect of the present invention, there is provided a valve operation control system for an internal combustion engine comprising: hydraulic valve operation mode changing mechanisms disposed for each of a plurality of cylinders in order to switch the operation mode of an engine valve openably and closably disposed in a cylinder head of an engine main body having the cylinders; and hydraulic pressure control means having a holder mounted on the cylinder head and a spool valve that is formed by slidably housing a spool valve body in a valve body mounted on the holder and that controls hydraulic pressure applied to the valve operation mode changing mechanisms; characterized in that the hydraulic pressure control means has a first spool valve formed by slidably housing a first spool valve body in the valve body to operate so as to apply hydraulic pressure of a source pressure oil passage by alternatively switching mutually independent first and second oil passages, and a second spool valve that is formed by slidably housing a second spool valve body in the valve body and is connected to the first spool valve via the first and second oil passages, the first oil passage being formed in the valve body and the second oil passage being formed in the holder.

According to a sixth aspect of the present invention, in addition to the fifth aspect, the second oil passage is formed on a joining face of the holder by which the holder is joined to the valve body.

According to a seventh aspect of the present invention, in addition to the fifth or sixth aspect, the first and second spool valve bodies are slidably housed in the valve body so as to have mutually parallel axes in a direction perpendicular to a cylinder arrangement direction of the plurality of cylinders, which are disposed in-line.

According to an eighth aspect of the present invention, in addition to the seventh aspect, the first and second spool valve bodies are slidably housed in the valve body so that pilot hydraulic chambers, which end parts of the spool valve bodies respectively face, are close to each other and moving directions when hydraulic pressure is applied to the two pilot hydraulic chambers are opposite to each other.

An intake valve VI and an exhaust valve VE of an embodiment correspond to the engine valve of the present invention.

Effects of the Invention

In accordance with the first aspect of the present invention, since the holder is formed by integrally connecting, by the connection portion, the housed portion that is housed between the head cover and the cylinder head and the projecting portion that projects outside the cylinder head and the head cover and is provided with the electromagnetic open/close valve, and the valve body is provided so as to be connected to the housed portion while being housed between the head cover and the cylinder head, drain oil from the valve body can be returned directly to the interior of the head cover; since it is only the oil passage connected to the electromagnetic open/close valve mounted on the holder that is provided in the connection portion of the holder, the cross-sectional area of the holder in a portion where the seal face is formed, that is, the cross-sectional area of the connection portion, can be made relatively small, and sealing properties on the seal face can be enhanced.

Furthermore, in accordance with the second aspect of the present invention, since the housed portion of the holder is secured to the cylinder head at the two mutually spaced positions, and the joining face of the valve body, which is a separate body from the holder, by which it is joined to the housed portion is set so as to be parallel to the joining face of the holder by which it is joined to the cylinder head and is disposed between the two positions at which the housed portion is secured to the cylinder head, the valve body is mounted on the housed portion of the holder in a portion where the mounting rigidity is high, and the mounting rigidity of the valve body can be enhanced.

In accordance with the third aspect of the present invention, since the spool valve bodies of the pair of spool valves are slidably housed in the valve body so as to have mutually parallel axes in a direction perpendicular to the cylinder arrangement direction of the plurality of cylinders, which are disposed in-line, it is possible to reduce the size of the valve body in the cylinder arrangement direction.

In accordance with the fourth aspect of the present invention, by making the pilot hydraulic chambers of the pair of spool valves close to each other, two pilot oil passages communicating with the two pilot hydraulic chambers are made close to each other, and it is thus possible to arrange the two pilot oil passages compactly, thereby reducing any loss in hydraulic pressure of the pilot oil passage to a low level.

In accordance with the fifth aspect of the present invention, since, among the first and second oil passages that provide a connection between the first and second spool valves and are independent from each other, the first oil passage is formed in the valve body and the second oil passage is formed in the holder, and the first and second oil passages are formed so as to be divided between the valve body and the holder, which are separate members from each other, it is possible to reduce the size by reducing the space required for formation of the first and second oil passages while avoiding interference between the first and second oil passages and to enhance the ease of machining of the first and second oil passages.

In accordance with the sixth aspect of the present invention, since the second oil passage is formed in the joining face of the holder by which it is joined to the valve body, it becomes easy to form the second oil passage.

In accordance with the seventh aspect of the present invention, since the first and second spool valve bodies are slidably housed in the valve body so as to have mutually parallel axes in a direction perpendicular to the cylinder arrangement direction of the plurality of cylinders, which are disposed in-line, it is possible to reduce the size of the valve body in the cylinder arrangement direction of the cylinders.

In accordance with the eighth aspect of the present invention, by making the pilot hydraulic chambers of the first and second spool valves close to each other the two pilot oil passages, which communicate with the two pilot hydraulic chambers, are made close to each other, and it is thus possible to arrange the two pilot oil passages compactly, thereby reducing any loss in hydraulic pressure of the pilot oil passage to a low level.

EXPLANATION OF REFERENCE NUMERALS AND SYMBOLS

Figure 1:
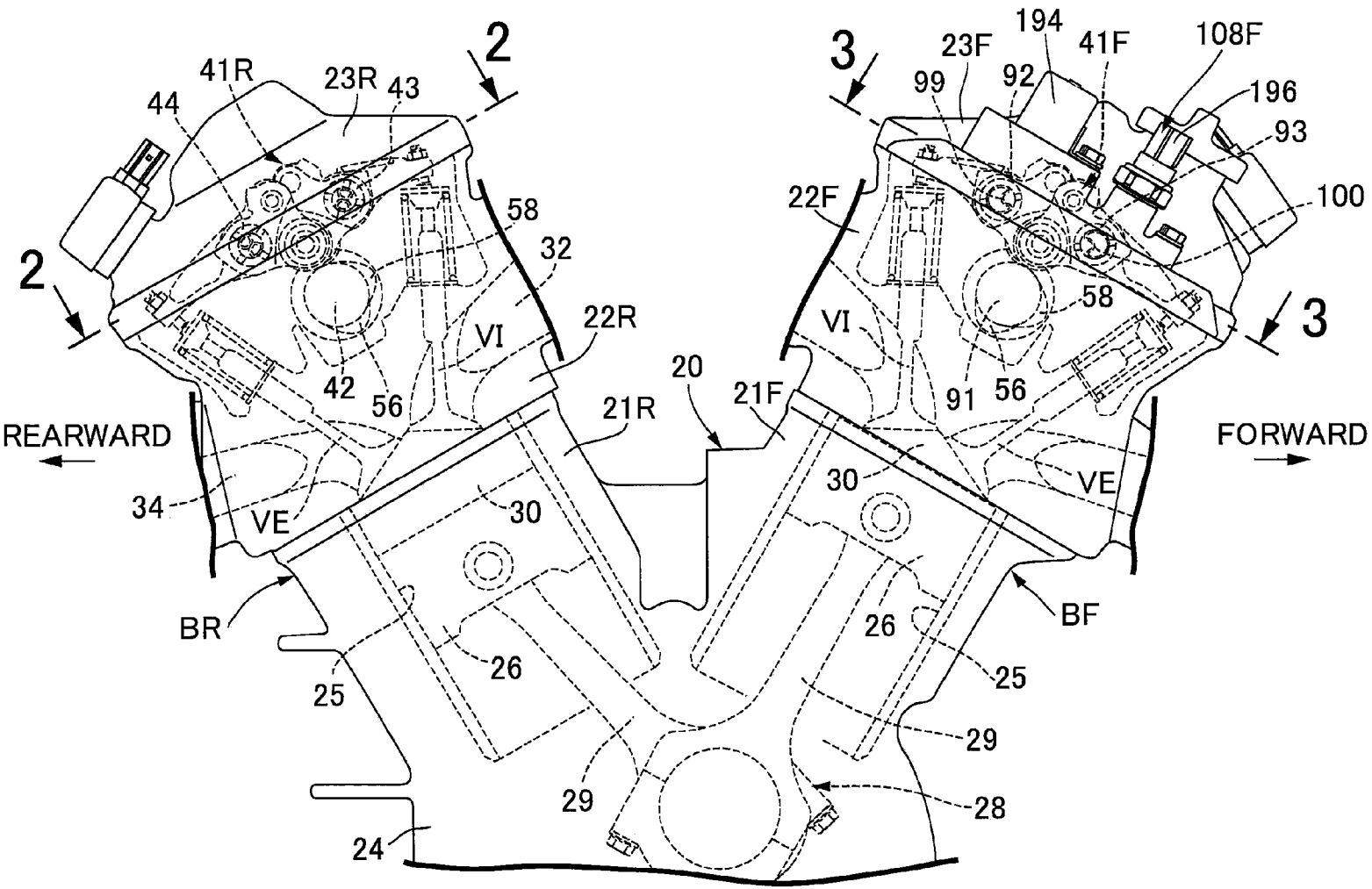
FIG. 1 is a right side view of a V-type multicylinder internal combustion engine. (first embodiment)

20 Engine main body
22R Rear cylinder head
23R Rear head cover
27 Cylinder arrangement direction
63 Intake side valve operation mode changing mechanism
75 Exhaust side valve operation mode changing mechanism
108R Hydraulic pressure control means
109 Holder
109*a* Housed portion
109*b* Projecting portion
109*c* Connection portion
109*e* Joining face of holder by which it is joined to valve body
110 Valve body
110*a* Joining face of valve body by which it is joined to holder
111 First spool valve
112 Second spool valve
113, 114 Electromagnetic open/close valve
116, 117 Seal face
122, 124 Pilot hydraulic chamber
123 First spool valve body
125 Second spool valve body
145 Source pressure oil passage
171 First oil passage
172 Second oil passage
C1, C2, C3 Cylinder
VI Intake valve, which is an engine valve
VE Exhaust valve, which is an engine valve

BEST MODE FOR CARRYING OUT THE INVENTION

A mode for carrying out the present invention is explained below by reference to FIG. 1 to FIG. 18.

Embodiment 1

First, in FIG. 1 an engine main body 20 of a V-type multi-cylinder internal combustion engine installed in a vehicle has a rear bank BR, and a front bank BF disposed in front of the rear bank BR so as to form a V shape in cooperation with the rear bank BR. The rear bank BR is formed from a rear cylinder block 21R, a rear cylinder head 22R joined to the upper end of the rear cylinder block 21R, and a rear head cover 23R joined to the rear cylinder head 22R, and the front bank BF is formed from a front cylinder block 21F, a front cylinder head 22F joined to the upper end of the front cylinder block 21F, and a front head cover 23F joined to the front cylinder head 22F. The rear and front cylinder blocks 21R and 21F are formed integrally with a crankcase 24.

Figure 2:
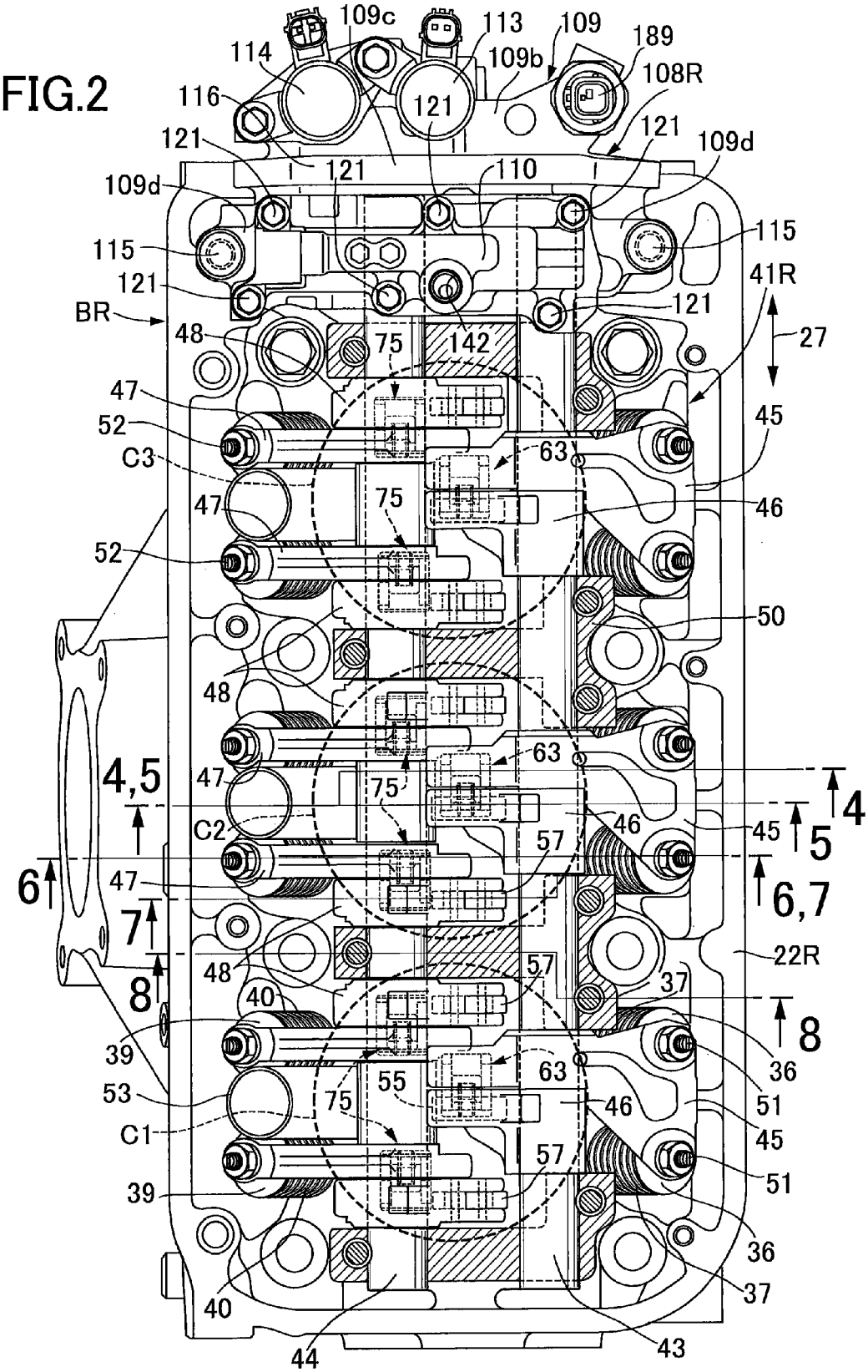
FIG. 2 is a sectional view along line 2-2 in FIG. 1 in a state in which a rear head cover is removed and a camshaft is omitted. (first embodiment)
Figure 3:
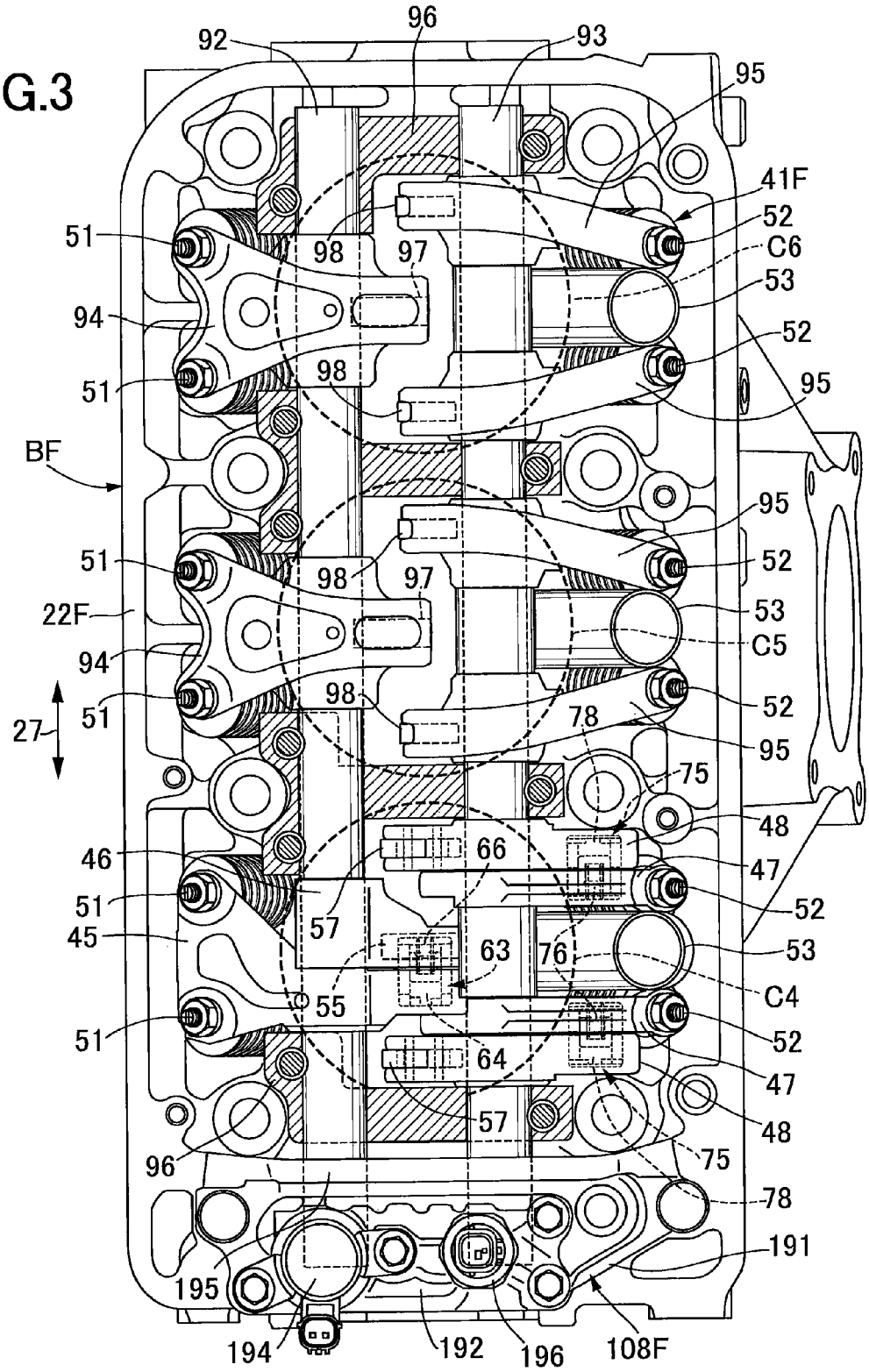
FIG. 3 is a sectional view along line 3-3 in FIG. 1 in a state in which a front head cover is removed and a camshaft is omitted. (first embodiment)

As shown in FIG. 2 the rear bank BF has first, second, and third cylinders C1, C2, and C3 that are arranged in-line in sequence from the right-hand side when facing forward in the travel direction of the vehicle, and as shown in FIG. 3 the front bank BF has fourth, fifth, and sixth cylinders C4, C5, and C6 that are arranged in-line in sequence from the right-hand side when facing forward in the travel direction of the vehicle.

The rear and front cylinder blocks 21R and 21F are provided with cylinder bores 25 for each of the cylinders C1 to C6, and pistons 26 slidably fitted into the cylinder bores 25 are connected in common to a single crankshaft 28 via connecting rods 29, the crankshaft 28 extending along a cylinder arrangement direction 27 of the rear and front banks BR and BF and being rotatably supported on the crankcase 24.

Referring in addition to FIG. 4 to FIG. 8, the arrangement of the engine main body 20 on the rear bank BR side is now explained. Formed between the rear cylinder head 22R and the pistons 26 within the cylinder bores 25 are combustion chambers 30 for each of the first to third cylinders C1 to C3. Provided in the rear cylinder head 22R in portions corresponding to each of the combustion chambers 30 are a pair of intake valve openings 31 communicating with the combustion chamber 30, an intake port 32 communicating with these intake valve openings 31 in common and opening on a front side face of the rear cylinder head 22R, a pair of exhaust valve openings 33 communicating with the combustion chamber 30, and an exhaust port 34 communicating with these exhaust valve openings 33 in common and opening on a rear side face of the rear cylinder head 22R.

Stems of a pair of intake valves VI and VI, which are engine valves that can individually open and close the intake valve openings 31 forming a pair for each of the first to third cylinders C1 to C3, are slidably fitted into guide tubes 35 provided in the rear cylinder head 22R, and valve springs 37 urging the intake valves VI in a valve-closing direction are provided between the rear cylinder head 22R and retainers 36 provided on an upper end part of the intake valves VI. Furthermore, stems of a pair of exhaust valves VE and VE, which are engine valves that can individually open and close the exhaust valve openings 33 forming a pair for each of the first to third cylinders C1 to C3, are slidably fitted into guide tubes 38 provided in the rear cylinder head 22R, and valve springs 40 urging the exhaust valves VE in a valve-closing direction are provided between the rear cylinder head 22R and retainers 39 provided on an upper end part of the exhaust valves VE.

The intake valves VI and VI and the exhaust valves VE and VE of the first to third cylinders C1 to C3 are opened and closed by a valve-operating device 41R, the valve-operating device 41R including a camshaft 42 having an axis parallel to the crankshaft 28, intake side and exhaust side rocker shafts 43 and 44 having axes parallel to the camshaft 42, intake side drive rocker arms 45 and intake side free rocker arms 46 rockably supported on the intake side rocker shaft 43 for each of the first to third cylinders C1 to C3, and exhaust side drive rocker arms 47 and exhaust side free rocker arms 48 rockably supported on the exhaust side rocker shaft 44 for each of the exhaust valves VE of the first to third cylinders C1 to C3.

A plurality (four in this embodiment) of bearing parts 49 are projectingly provided integrally with the rear cylinder head 22R at intervals along the cylinder arrangement direction 27 so that the combustion chambers 30 are interposed therebetween, and the camshaft 42 is rotatably supported by these bearing parts 49. Moreover, rotational power that is reduced in speed at a reduction ratio of ½ is transmitted from the crankshaft 28 to the camshaft 42.

The intake side and exhaust side rocker shafts 43 and 44 are fixedly disposed above the camshaft 42, and a rocker shaft holder 50 supporting the intake side and exhaust side rocker shafts 43 and 44 is secured and fixed to an upper face of the bearing parts 49.

Figure 9:
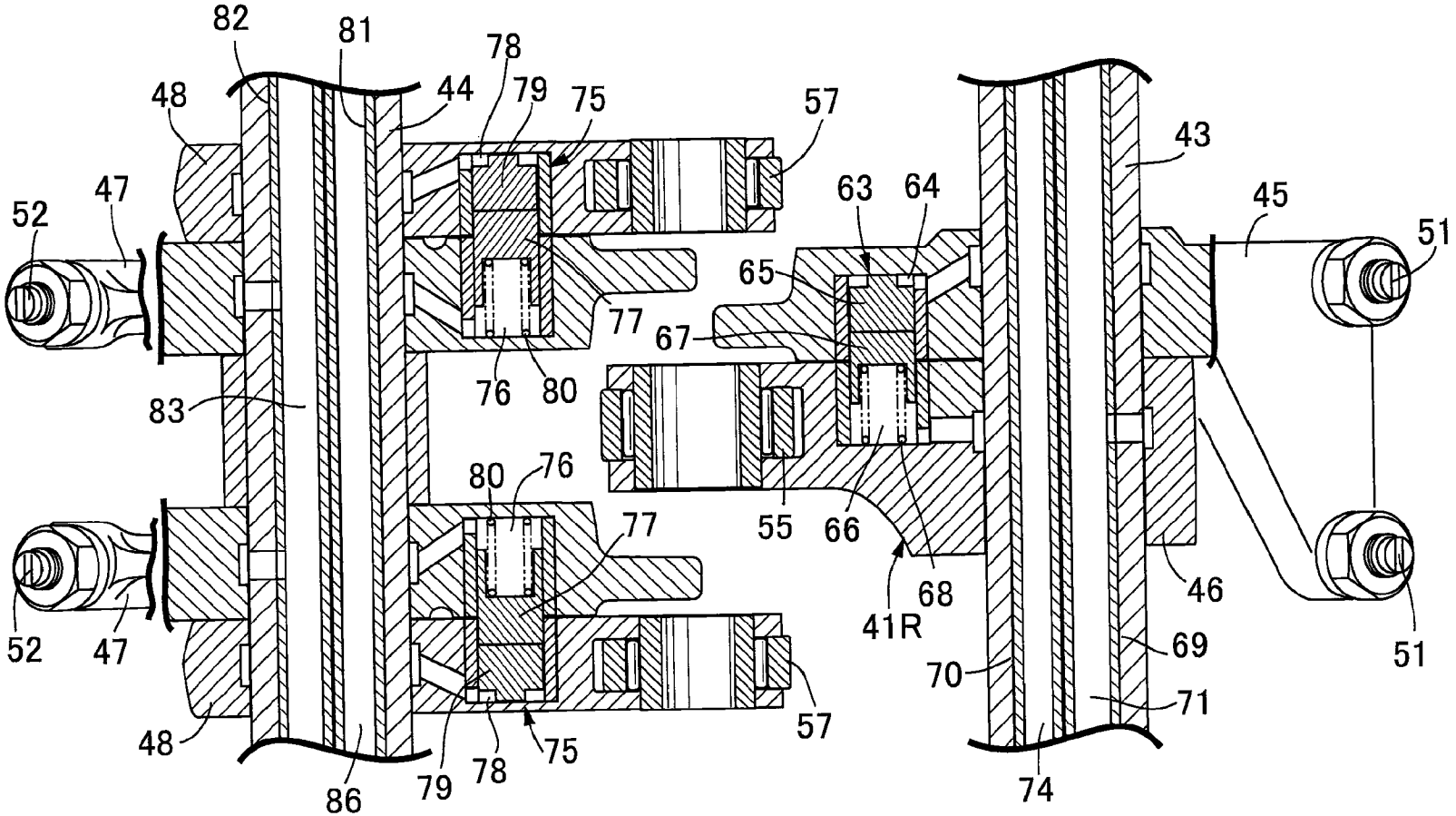
FIG. 9 is a sectional view along line 9-9 in FIG. 7. (first embodiment)

Referring in addition to FIG. 9, the intake side drive rocker arm 45 and the intake side free rocker arm 46 are rockably supported on the intake side rocker shaft 43 at mutually adjacent positions. The intake side drive rocker arm 45 is formed so as to extend above the stems of the pair of intake valves VI and VI, and the intake side drive rocker arm 45 is operatively connected to the intake valves VI and VI by a pair of tappet screws 51 and 51 abutting against the upper ends of the stems of the intake valves VI and VI, the tappet screws 51 and 51 being screwed into the intake side drive rocker arm 45 so that the back and forth position is adjustable.

Furthermore, the exhaust side drive rocker arm 47 and the exhaust side free rocker arm 48 are rockably supported on the exhaust side rocker shaft 44 at adjacent positions corresponding to the exhaust valve VE, and the exhaust side drive rocker arm 47 is operatively connected to the exhaust valve VE by a tappet screw 52 abutting against the upper end of the exhaust valve VE, the tappet screw 52 being screwed into the exhaust side drive rocker arm 47 so that the back and forth position thereof is adjustable.

Moreover, plug insertion tubes 53 are mounted in the rear cylinder head 22R so as to be positioned between the exhaust side drive rocker arms 47 and 47, which form a pair for each of the first to third cylinders C1 to C3, and ignition plugs 54 inserted into the plug insertion tubes 53 are screwed into the rear cylinder head 22R so as to face the respective combustion chambers 30.

The camshaft 42 is provided with an intake side cam 56 that is in rolling contact with a roller 55 axially supported on the intake side free rocker arm 46 (see FIG. 5), an exhaust side cam 58 that is in rolling contact with a roller 57 axially supported on the exhaust side free rocker arm 48 (see FIG. 7), a cut-off part 59 that is in sliding contact with a slipper 45*a* provided on the intake side drive rocker arm 45 (see FIG. 4), and a cut-off part 60 that is in sliding contact with a slipper 47*a* provided on the exhaust side drive rocker arm 47 (see FIG. 6), and outer peripheries of the cut-off parts 59 and 60 are formed in circular shapes having the same radius from the center of the camshaft 42 so as to correspond to the base circular part of the intake side and exhaust side cams 56 and 58. That is, the cut-off parts 59 and 60 are formed so as to close and cut off the intake valves VI and VI and the exhaust valves VE and VE. The intake valves VI and VI are opened and closed by the intake side free rocker arm 46 rocking by following the intake side cam 56 when the intake side drive rocker arm 45 is connected to the intake side free rocker arm 46, but when the intake side drive rocker arm 45 and the intake side free rocker arm 46 are disconnected, the intake side drive rocker arm 45 remains urged by the valve spring 37 toward the side on which the slipper 45*a* thereof is in sliding contact with the cut-off part 59, thus attaining a valve-closed cut-off state. Furthermore, the exhaust valve VE is opened and closed by the exhaust side free rocker arm 48 rocking by following the exhaust side cam 58 in a state in which the exhaust side drive rocker arm 47 is connected to the exhaust side free rocker arm 48, but when the exhaust side drive rocker arm 47 and the exhaust side free rocker arm 48 are disconnected, the exhaust side drive rocker arm 47 remains urged by the valve spring 40 toward the side on which the slipper 47*a* thereof is in sliding contact with the cut-off part 60, thus attaining a valve-closed cut-off state.

The intake side drive rocker arm 45 and the intake side free rocker arm 46 are provided with a hydraulic intake side valve operation mode changing mechanism 63 that switches the operation mode of the intake valves VI and VI between an opening/closing state and a valve-closed cut-off state by switching by means of hydraulic pressure between connection of the intake side drive rocker arm 45 to the intake side free rocker arm 46 and disconnection thereof.

In FIG. 9, the intake side valve operation mode changing mechanism 63 includes a piston 65 that has one end facing a cut-off side hydraulic chamber 64 formed within the intake side drive rocker arm 45 and is slidably fitted into the intake side drive rocker arm 45, a connecting pin 67 that has one end in sliding contact with the other end of the piston 65, is slidably fitted into the intake side free rocker arm 46 and the intake side drive rocker arm 45, and has the other end facing an operation side hydraulic chamber 66 formed within the intake side free rocker arm 46, and a return spring 68 that is housed in the operation side hydraulic chamber 66 and is provided between the intake side free rocker arm 46 and the connecting pin 67.

In this intake side valve operation mode changing mechanism 63, when hydraulic pressure is applied to the operation side hydraulic chamber 66, as shown in FIG. 9 the mutually connected connecting pin 67 and piston 65 move to a position at which the volume of the cut-off side hydraulic chamber 64 is a minimum, and the intake side drive rocker arm 45 and the intake side free rocker arm 46 are connected by the connecting pin 67. Furthermore, when hydraulic pressure is applied to the cut-off side hydraulic chamber 64, the mutually connected piston 65 and connecting pin 67 move to a position at which the volume of the operation side hydraulic chamber 66 is a minimum, and since contact faces of the piston 65 and the connecting pin 67 are present between the intake side drive rocker arm 45 and the intake side free rocker arm 46, the intake side drive rocker arm 45 and the intake side free rocker arm 46 are disconnected.

In this way, the intake side valve operation mode changing mechanism 63 changes the operation mode of the intake valves VI and VI between the opening/closing state and the valve-closed cut-off state by switching between connection and disconnection of the intake side drive rocker arm 45 and the intake side free rocker arm 46 by alternatively applying hydraulic pressure to the cut-off side hydraulic chamber 64 and the operation side hydraulic chamber 66, and a cylinder of the first to third cylinders C1 to C3 in which the intake valves VI and VI are in a valve-closed cut-off state attains a cylinder cut-off state. Furthermore, the return spring 68 may exhibit a spring force at a level that can avoid rattling of the piston 65 and the connecting pin 67 in a state in which no hydraulic pressure is applied to either the cut-off side hydraulic chamber 64 or the operation side hydraulic chamber 66 in response to the engine stopping running.

Figure 4:
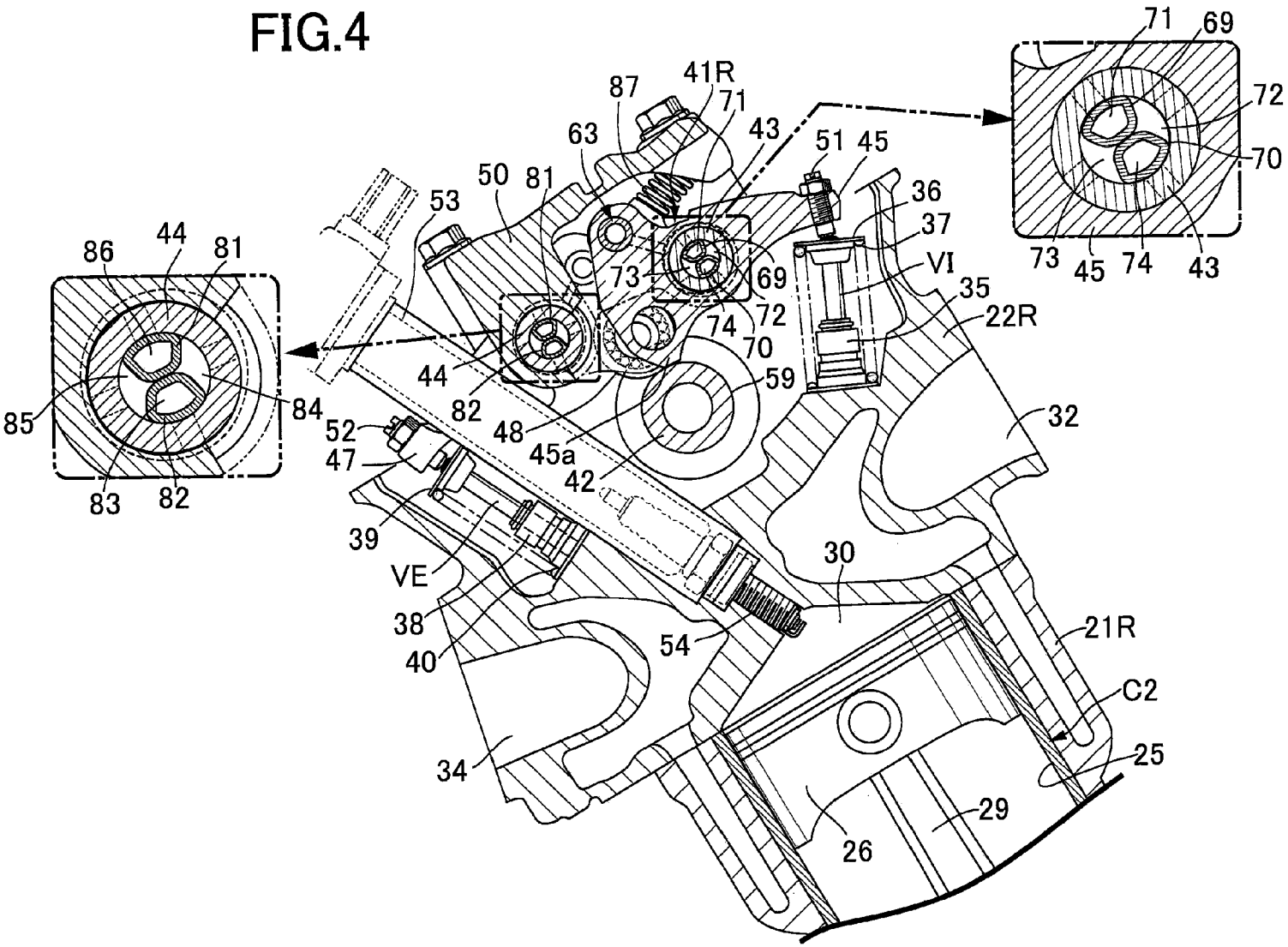
FIG. 4 is a sectional view along line 4-4 in FIG. 2. (first embodiment)
Figure 5:
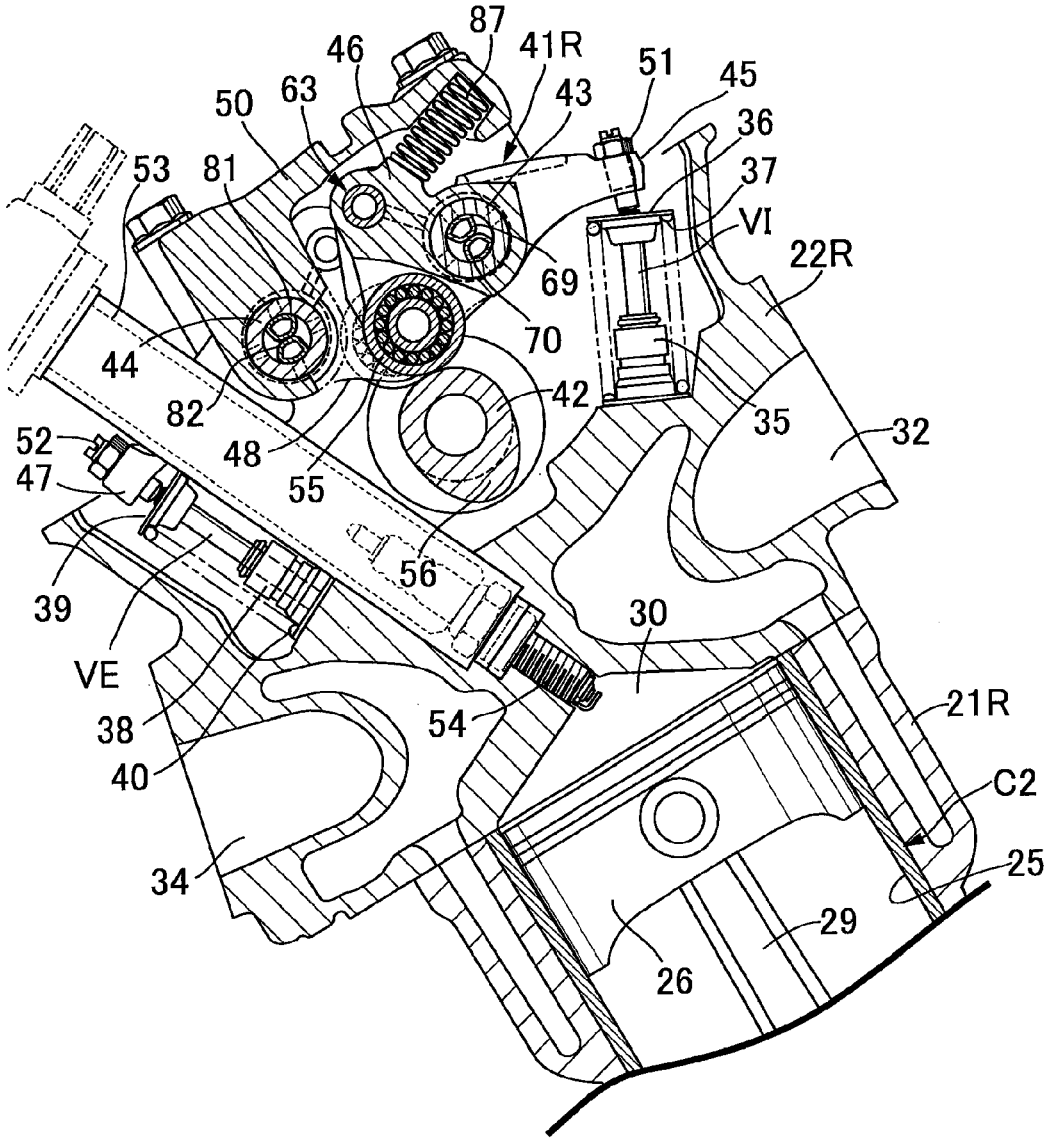
FIG. 5 is a sectional view along line 5-5 in FIG. 2. (first embodiment)
Figure 6:
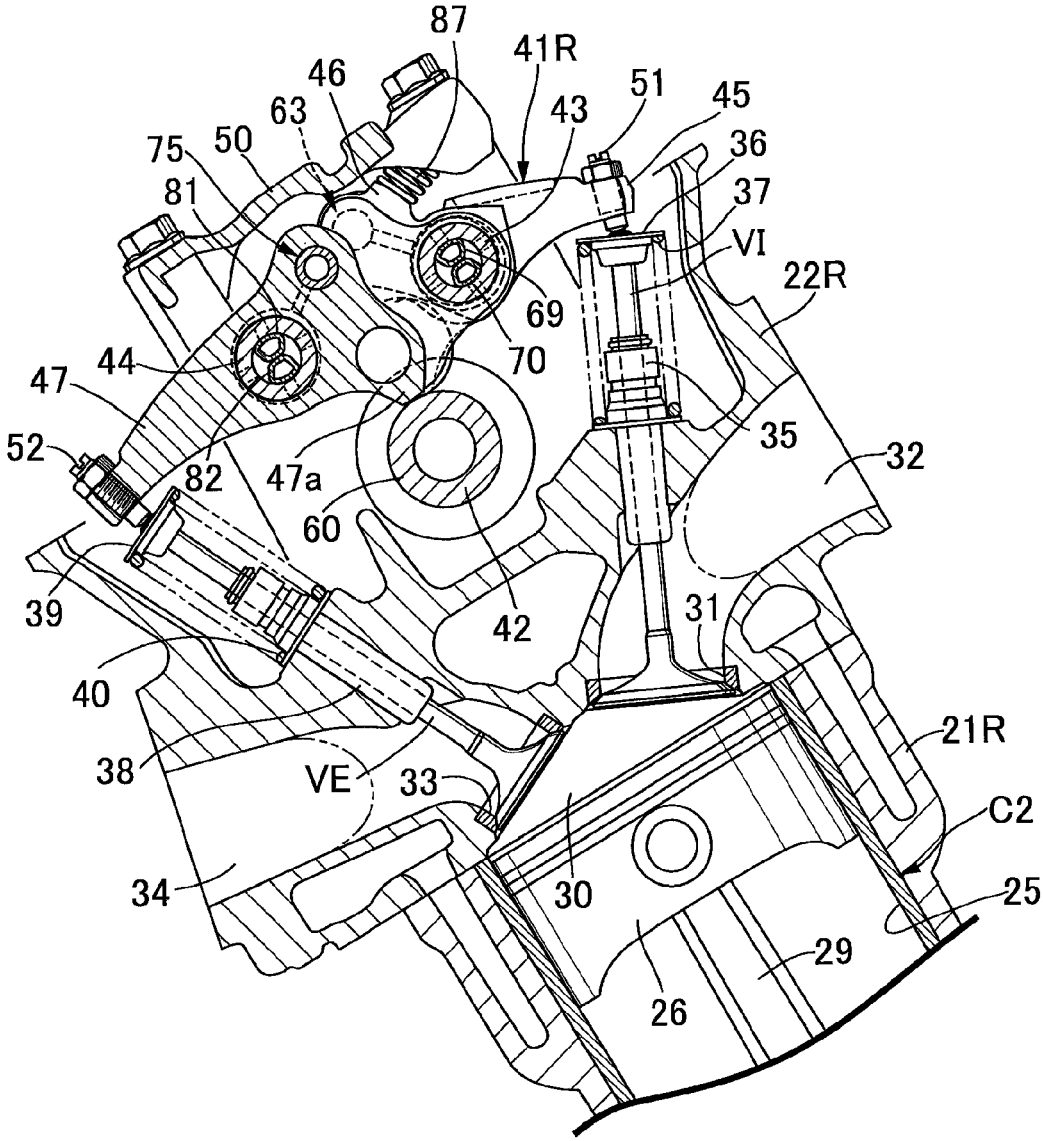
FIG. 6 is a sectional view along line 6-6 in FIG. 2. (first embodiment)
Figure 7:
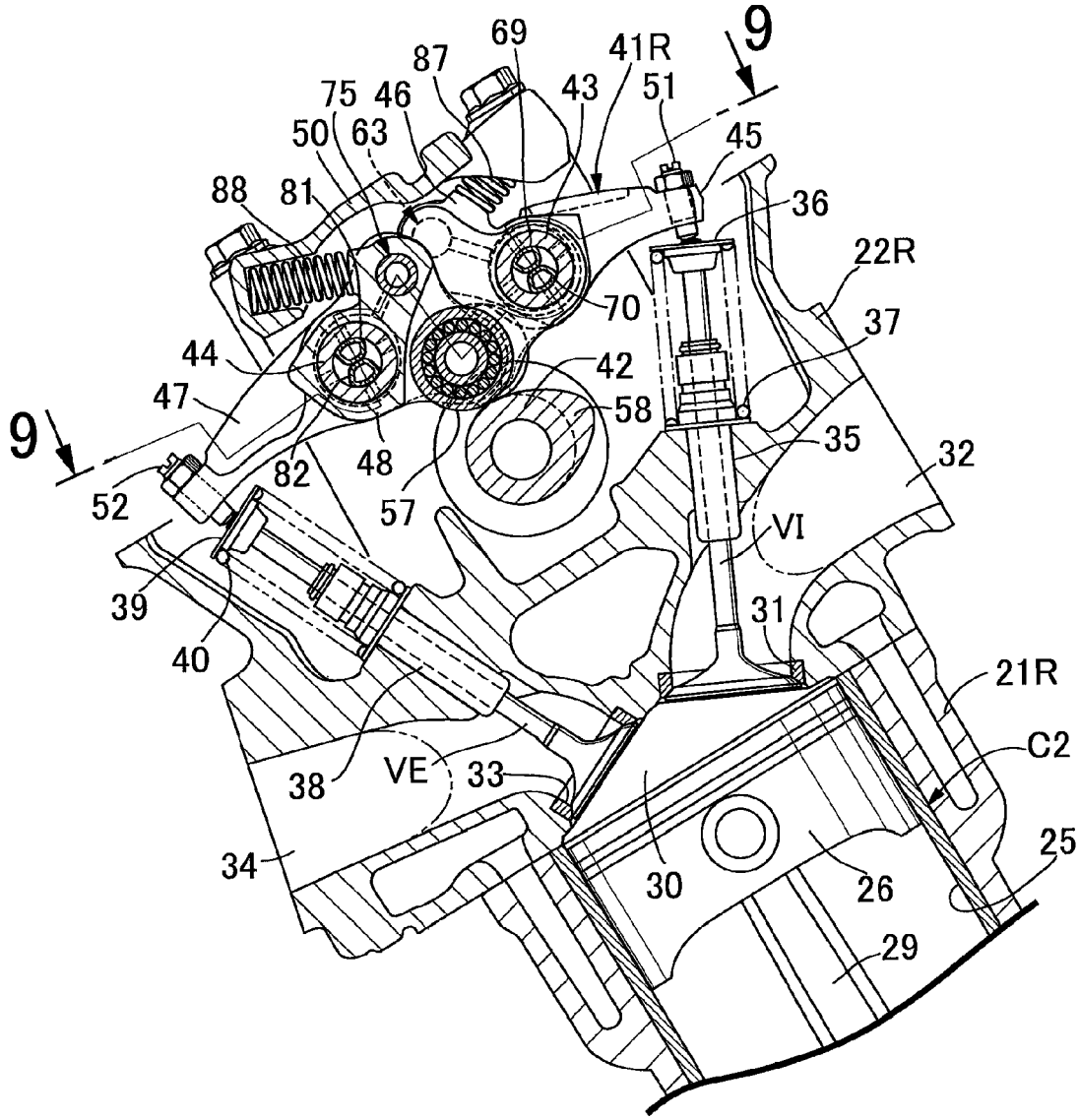
FIG. 7 is a sectional view along line 7-7 in FIG. 2. (first embodiment)
Figure 8:
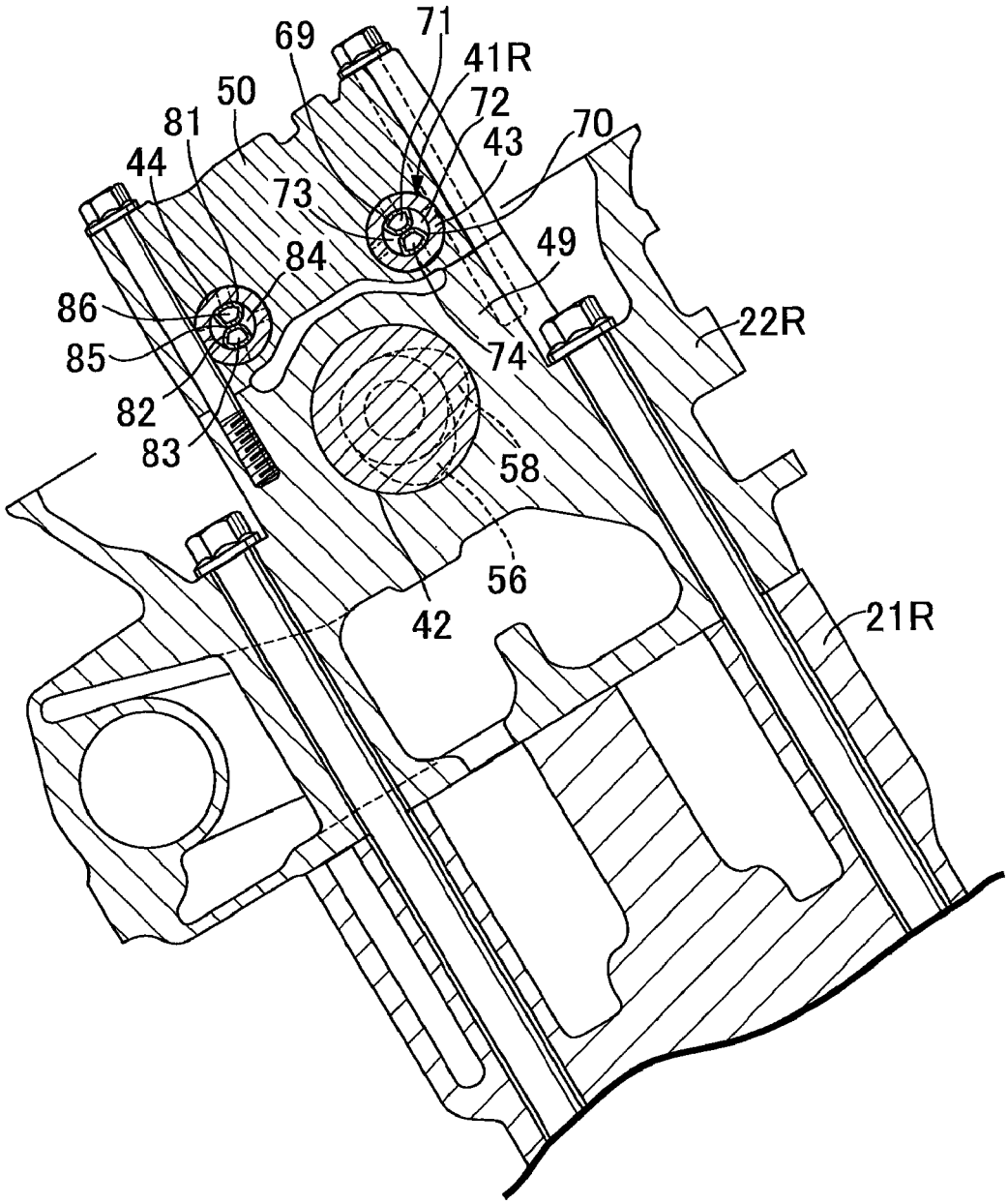
FIG. 8 is a sectional view along line 8-8 in FIG. 2. (first embodiment)

Fitted into the intake side rocker shaft 43 are two tubular dividing members 69 and 70 that divide the interior of the rocker shaft 43 into four. These dividing members 69 and 70 form first and second operation side oil passages 71 and 72 and first and second cut-off side oil passages 73 and 74 independently from each other in the interior of the intake side rocker shaft 43 as shown in FIG. 4 and FIG. 8.

Figure 10:
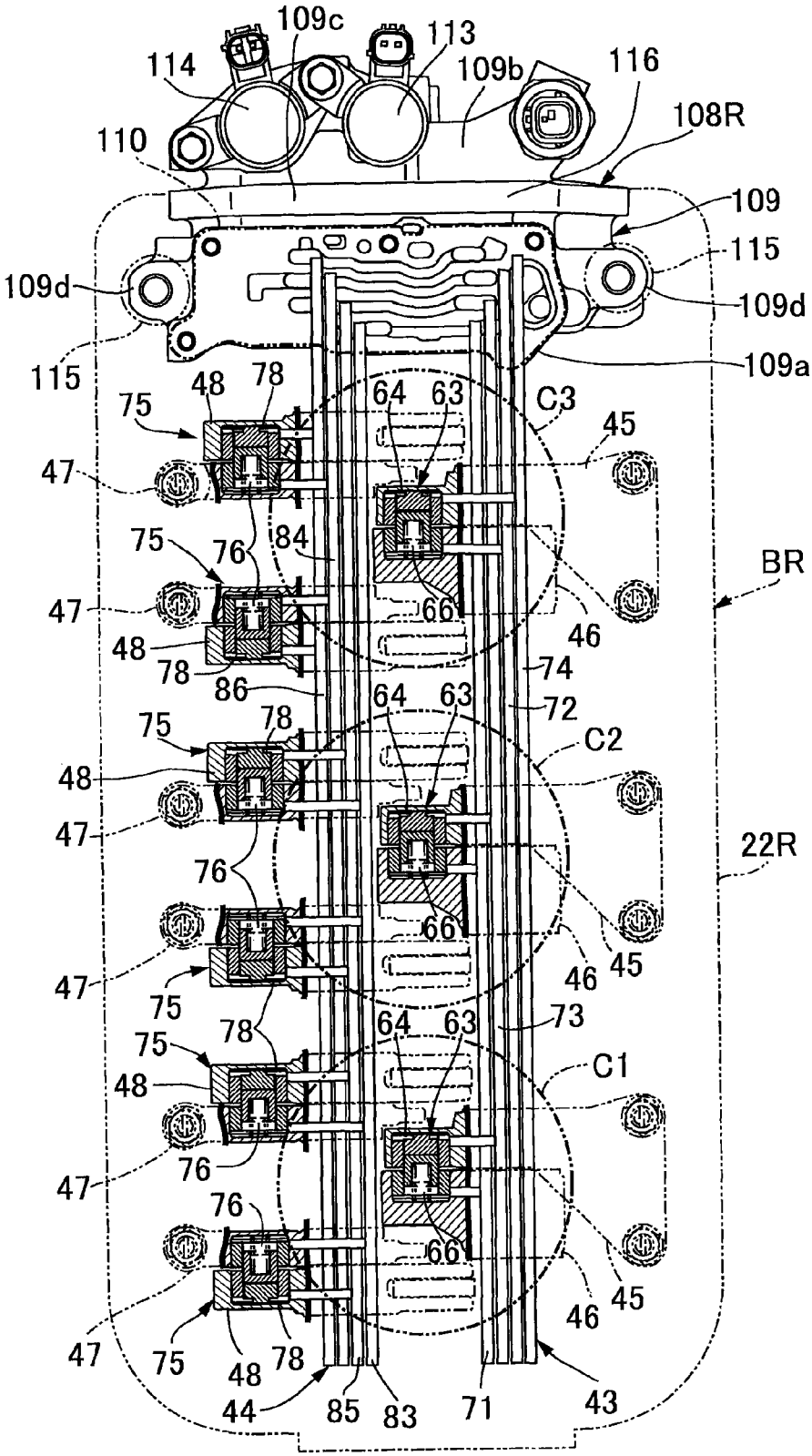
FIG. 10 is a simplified diagram showing a state in which oil passages are connected to rear bank intake side and exhaust side valve operation mode changing mechanisms. (first embodiment)

Referring in addition to FIG. 10, the first operation side oil passage 71 communicates with the operation side hydraulic chambers 66 of the intake side valve operation mode changing mechanisms 63 of the first and second cylinders C1 and C2, the second operation side oil passage 72 communicates with the operation side hydraulic chamber 66 of the intake side valve operation mode changing mechanism 63 of the third cylinder C3, the first cut-off side oil passage 73 communicates with the cut-off side hydraulic chambers 64 of the intake side valve operation mode changing mechanisms 63 of the first and second cylinders C1 and C2, and the second cut-off side oil passage 74 communicates with the cut-off side hydraulic chamber 64 of the intake side valve operation mode changing mechanism 63 of the third cylinder C3.

Referring again to FIG. 9, provided on the exhaust side drive rocker arm 47 and the exhaust side free rocker arm 48 is an exhaust side valve operation mode changing mechanism 75 that switches over the operation mode of the exhaust valve VE between an opening/closing state and a valve-closed cut-off state by switching by means of hydraulic pressure between connection of the exhaust side drive rocker arm 47 to the exhaust side free rocker arm 48 and disconnection thereof.

The exhaust side valve operation mode changing mechanism 75 includes a connecting pin 77 that is slidably fitted into the exhaust side drive rocker arm 47 and the exhaust side free rocker arm 48 so as to have one end facing an operation side hydraulic chamber 76 formed within the exhaust side drive rocker arm 47, a piston 79 that is slidably fitted into the exhaust side free rocker arm 48 so that one end is in sliding contact with the other end of the connecting pin 77 and has the other end facing a cut-off side hydraulic chamber 78 formed within the exhaust side free rocker arm 48, and a return spring 80 that is housed in the operation side hydraulic chamber 76 and is provided between the exhaust side drive rocker arm 47 and the connecting pin 77.

In this exhaust side valve operation mode changing mechanism 75, when hydraulic pressure is applied to the operation side hydraulic chamber 76, as shown in FIG. 9, the mutually connected connecting pin 77 and piston 79 move to a position at which the volume of the cut-off side hydraulic chamber 78 is a minimum, and the exhaust side drive rocker arm 47 and the exhaust side free rocker arm 48 are connected by the connecting pin 77. Furthermore, when hydraulic pressure is applied to the cut-off side hydraulic chamber 78, the mutually connected connecting pin 77 and piston 79 move to a position at which the volume of the operation side hydraulic chamber 76 is a minimum, and since the contact faces of the connecting pin 77 and the piston 79 are present between the exhaust side free rocker arm 48 and the exhaust side drive rocker arm 47, the exhaust side free rocker arm 48 and the exhaust side drive rocker arm 47 are disconnected.

In this way, the exhaust side valve operation mode changing mechanism 75 switches over between connection and disconnection of the exhaust side drive rocker arm 47 and the exhaust side free rocker arm 48 by alternatively applying hydraulic pressure to the operation side hydraulic chamber 76 and the cut-off side hydraulic chamber 78 to thus switch the operation mode of the exhaust valve VE between the opening/closing state and the valve-closed cut-off state, and for the first to third cylinders C1 to C3 a cylinder for which a pair of exhaust valves VE and VE are in a valve-closed cut-off state attains a cylinder cut-off state. Furthermore, the return spring 80 may exhibit a spring force at a level that can avoid ratting of the connecting pin 77 and the piston 79 in a state in which no hydraulic pressure is applied to either the operation side hydraulic chamber 76 or the cut-off side hydraulic chamber 78 in response to the engine stopping running.

Fitted into the exhaust side rocker shaft 44 are tubular dividing members 81 and 82 that divide the interior of the rocker shaft 44 into four. These dividing members 81 and 82 form third and fourth operation side oil passages 83 and 84 and third and fourth cut-off side oil passages 85 and 86 independently from each other in the interior of the exhaust side rocker shaft 44 as shown in FIG. 4 and FIG. 8.

In FIG. 10, the third operation side oil passage 83 communicates with the operation side hydraulic chambers 76 of the exhaust side valve operation mode changing mechanisms 75 of the first and second cylinders C1 and C2, the fourth operation side oil passage 84 communicates with the operation side hydraulic chamber 76 of the exhaust side valve operation mode changing mechanism 75 of the third cylinder C3, the third cut-off side oil passage 85 communicates with the cut-off side hydraulic chambers 78 of the exhaust side valve operation mode changing mechanisms 75 of the first and second cylinders C1 and C2, and the fourth cut-off side oil passage 86 communicates with the cut-off side hydraulic chamber 78 of the exhaust side valve operation mode changing mechanism 75 of the third cylinder C3.

A lost motion spring 87 is provided between the rocker shaft holder 50 and the intake side free rocker arm 46, the lost motion spring 87 exhibiting a spring force that presses the roller 55 of the intake side free rocker arm 46 against the intake side cam 56 of the camshaft 42 in a state in which the intake side valve operation mode changing mechanism 63 has disconnected the intake side free rocker arm 46 and the intake side drive rocker arm 45. Furthermore, a lost motion spring 88 is provided between the rocker shaft holder 50 and the exhaust side free rocker arm 48, the lost motion spring 88 exhibiting a spring force that presses the roller 57 of the exhaust side free rocker arm 48 against the exhaust side cam 58 of the camshaft 42 in a state in which the exhaust side valve operation mode changing mechanism 75 has disconnected the exhaust side free rocker arm 48 and the exhaust side drive rocker arm 47.

Referring to FIG. 3, in the front cylinder head 22F of the front bank BF, intake valves VI and VI and exhaust valves VE and VE, which are disposed as pairs for each of the fourth to sixth cylinders C4 to C6, are opened and closed by a valve-operating device 41F. This valve-operating device 41F includes a camshaft 91 having an axis parallel to the crankshaft 28 (see FIG. 1), intake side and exhaust side rocker shafts 92 and 93 having axes parallel to the camshaft 91, an intake side drive rocker arm 45 and an intake side free rocker arm 46 rockably supported on the intake side rocker shaft 92 of the fourth cylinder C4, exhaust side drive rocker arms 47 and exhaust side free rocker arms 48 rockably supported on the exhaust side rocker shaft 93 for each of the exhaust valves VE and VE of the fourth cylinder C4, one intake side rocker arm 94 rockably supported on the intake side rocker shaft 92 for each of the pair of intake valves VI and VI of the fifth and sixth cylinders C5 and C6, and one exhaust side rocker arm 95 rockably supported on the exhaust side rocker shaft 93 for each of the exhaust valves VE of the fifth and sixth cylinders C5 and C6.

The camshaft 91 is rotatably supported on the front cylinder head 22F, the intake side and exhaust side rocker shafts 92 and 93 are fixedly disposed above the camshaft 91, and rocker shaft holders 96 supporting the intake side and exhaust side rocker shafts 92 and 93 are secured and fixed to the front cylinder head 22F.

In the fourth cylinder C4, the intake side drive rocker arm 45 and the intake side free rocker arm 46 are adjacent to each other and are rockably supported on the intake side rocker shaft 92. The intake side drive rocker arm 45 is formed so as to extend above the stems of a pair of the intake valves VI and VI, and a pair of tappet screws 51 and 51 screwed into the intake side drive rocker arm 45 so that the back and forth positions thereof are adjustable abut against the upper ends of the stems of the intake valves VI and VI, thereby operatively connecting the intake side drive rocker arm 45 to the intake valves VI and VI. Furthermore, in the fifth and sixth cylinders C5 and C6, the intake side rocker arm 94 is formed so as to extend above the stems of a pair of the intake valves VI and VI, and a pair of tappet screws 51 and 51 screwed into the intake side rocker arm 94 so that the back and forth positions thereof are adjustable abut against the upper ends of the stems of the intake valves VI and VI, thereby operatively connecting the intake side rocker arm 94 to the intake valves VI and VI.

In the fourth cylinder C4, the exhaust side drive rocker arms 47 and the exhaust side free rocker arms 48 are adjacent to each other at positions corresponding to the exhaust valves VE and are rockably supported on the exhaust side rocker shaft 93. The exhaust side drive rocker arm 47 is operatively connected to the exhaust valve VE by making the tappet screw 52, which is screwed into the exhaust side drive rocker arm 47 so that the back and forth position thereof is adjustable, abut against the upper end of the exhaust valve VE. Furthermore, in the fifth and sixth cylinders C5 and C6, the exhaust side rocker arms 95 are operatively connected to the exhaust valves VE by making the tappet screws 52, which are screwed into the exhaust side rocker arms 95 so that the back and forth positions thereof are adjustable, abut against the upper ends of the stems of the exhaust valves VE.

Moreover, plug insertion tubes 53 are mounted in the front cylinder head 22F so as to be disposed between the pair of exhaust side drive rocker arms 47 and 47 of the fourth cylinder C4 and between the exhaust side rocker arms 95 and 95, which are disposed as a pair for each of the fifth and sixth cylinders C5 and C6, and ignition plugs (not illustrated) inserted into the plug insertion tubes 53 are screwed into the front cylinder head 22F so as to face each of the combustion chambers 30.

Provided on the camshaft 91 are intake side cams 56, exhaust side cams 58, and a cut-off part (not illustrated). The intake side cams 56 are in rolling contact with a roller 55 axially supported on the intake side free rocker arm 46 of the fourth cylinder C4 and rollers 97 axially supported on the intake side rocker arms 94 of the fifth and sixth cylinders C5 and C6 (see FIG. 1), the exhaust side cams 58 are in rolling contact with a roller 57 axially supported on the exhaust side free rocker arm 48 of the fourth cylinder C4 and rollers 98 axially supported on the exhaust side rocker arms 95 of the fifth and sixth cylinders C5 and C6 (see FIG. 1), and the cut-off part makes the intake side free rocker arm 6 and the exhaust side free rocker arms 48 be in sliding contact therewith in order to put the intake valves VI and VI and the exhaust valves VE and VE into a valve-closed cut-off state when the intake side drive rocker arm 45 and the intake side free rocker arm 46 are disconnected and the exhaust side drive rocker arm 47 and the exhaust side free rocker arm 48 are disconnected in the fourth cylinder C4.

Provided in the intake side drive rocker arm 45 and the intake side free rocker arm 46 of the fourth cylinder C4 is an intake side valve operation mode changing mechanism 63, which switches by means of hydraulic pressure between connection of the intake side drive rocker arm 45 to the intake side free rocker arm 46 and disconnection thereof as in the first to third cylinders C1 to C3 on the rear bank BR side. This intake side valve operation mode changing mechanism 63 switches the operation mode of the intake valves VI and VI of the fourth cylinder C4 between an opening/closing state and a valve-closed cut-off state by switching between connection of the intake side free rocker arm 46 to the intake side drive rocker arm 45 and disconnection thereof by alternatively applying hydraulic pressure to a cut-off side hydraulic chamber 64 and an operation side hydraulic chamber 66, and by closing and cutting off the intake valves VI and VI, the fourth cylinder C4 attains a cylinder cut-off state.

Furthermore, an exhaust side valve operation mode changing mechanism 75 is provided on the exhaust side drive rocker arm 47 and the exhaust side free rocker arm 48 of the fourth cylinder C4, the exhaust side valve operation mode changing mechanism 75 switching by means of hydraulic pressure between connection of the exhaust side drive rocker arm 47 to the exhaust side free rocker arm 48 and disconnection thereof in the same manner as in the first to third cylinders C1 to C3 on the rear bank BR side. This exhaust side valve operation mode changing mechanism 75 switches the operation mode of the exhaust valve VE between an opening/closing state and a valve-closed cut-off state by switching connection and disconnection between the exhaust side drive rocker arm 47 and the exhaust side free rocker arm 48 by alternatively applying hydraulic pressure to an operation side hydraulic chamber 76 and a cut-off side hydraulic chamber 78, and by closing and cutting off the pair of exhaust valves VE and VE the fourth cylinder C4 attains a cylinder cut-off state.

Fitted into the intake side rocker shaft 92 is a dividing member 99 (see FIG. 1) that divides the interior of the rocker shaft 92 into two, and fitted into the exhaust side rocker shaft 93 is a dividing member 100 (see FIG. 1) that divides the interior of the rocker shaft 93 into two.

Figure 11:
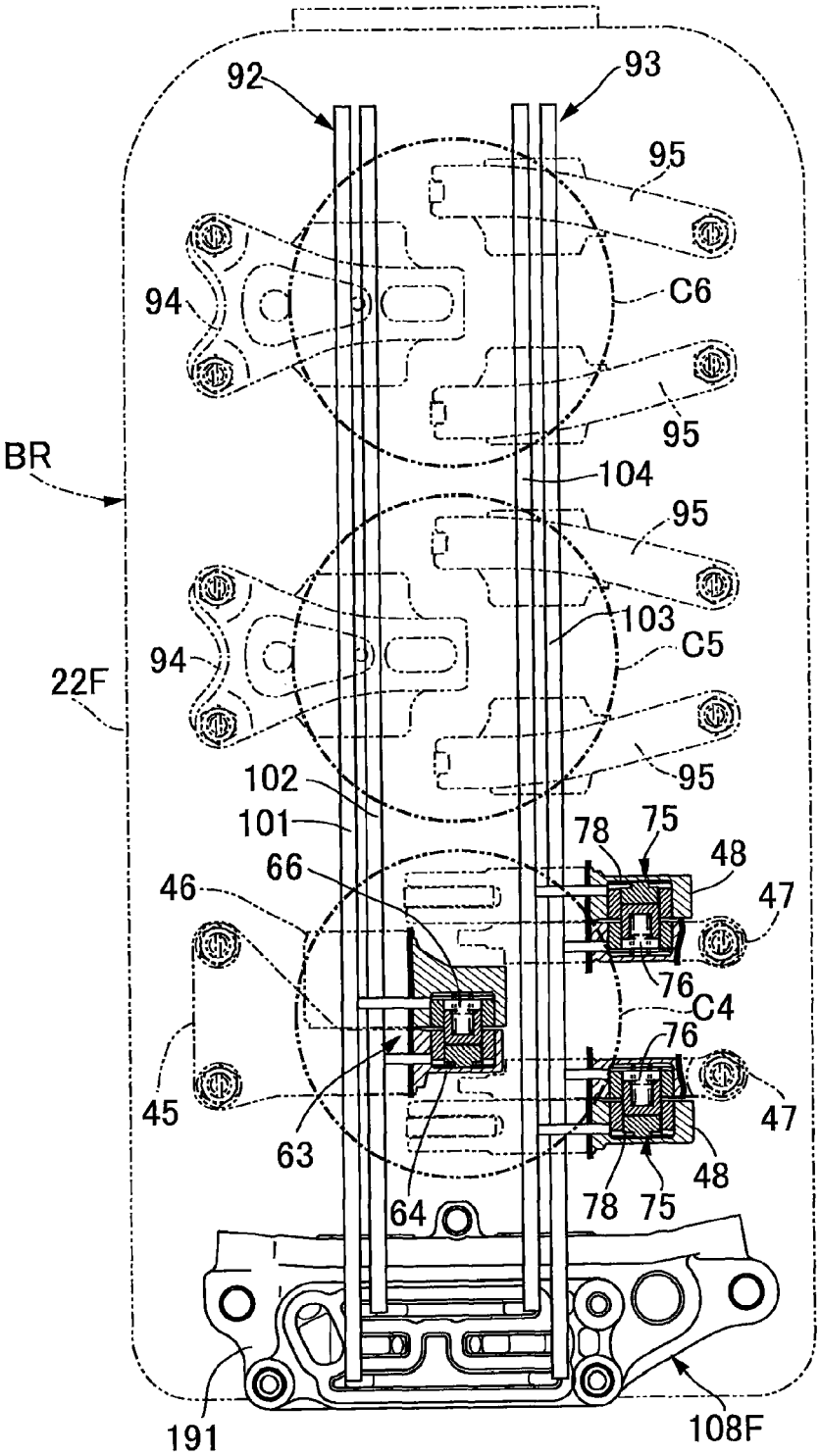
FIG. 11 is a simplified diagram showing a state in which oil passages are connected to front bank intake side and exhaust side valve operation mode changing mechanisms. (first embodiment)

Referring in addition to FIG. 11, a fifth operation side oil passage 101 and a fifth cut-off side oil passage 102 are formed in the interior of the intake side rocker shaft 92 by the dividing member 99 so as to be independent from each other, and a sixth operation side oil passage 103 and a sixth cut-off side oil passage 104 are formed in the interior of the exhaust side rocker shaft 93 by the dividing member 100 so as to be independent from each other.

The fifth operation side oil passage 101 communicates with the operation side hydraulic chamber 66 of the intake side valve operation mode changing mechanism 63 of the fourth cylinder C4, the sixth operation side oil passage 103 communicates with the operation side hydraulic chambers 76 of the exhaust side valve operation mode changing mechanisms 75 of the fourth cylinder C4, the fifth cut-off side oil passage 102 communicates with the cut-off side hydraulic chamber 64 of the intake side valve operation mode changing mechanism 63 of the fourth cylinder C4, and the sixth cut-off side oil passage 104 communicates with the cut-off side hydraulic chambers 78 of the exhaust side valve operation mode changing mechanisms 75 of the fourth cylinder C4.

As described above, among the first to sixth cylinders C1 to C6, the first to fourth cylinders C1 to C4 can be switched between a state in which the intake valves VI and the exhaust valves VE are opened and closed and a cylinder cut-off state in which the intake valves VI and the exhaust valves VE are closed and cut off, and according to driving conditions this V-type multicylinder internal combustion engine can be switched between a 6 cylinder operating state in which the intake valves VI and the exhaust valves VE are opened and closed in all of the first to sixth cylinders C1 to C6, a 4 cylinder operating state in which the intake valves VI and the exhaust valves VE of the third and fourth cylinders C3 and C4 are closed and cut off, and a 3 cylinder operating state in which the intake valves VI and the exhaust valves VE of the first to third cylinders C1 to C3 are closed and cut off.

The opening/closing state and the valve-closed cut-off state of the intake valves VI and the exhaust valves VE of the first to third cylinders C1 to C3 are switched by hydraulic pressure control of hydraulic pressure control means 108R disposed outside the third cylinder C3 along the cylinder arrangement direction 27, that is, in a left end part of the rear cylinder head 22R when facing forward in the travel direction of the vehicle, and the opening/closing state and the valve-closed cut-off state of the intake valves VI and the exhaust valves VE of the fourth cylinder C4 are switched by hydraulic pressure control of hydraulic pressure control means 108F disposed outside the fourth cylinder C4 along the cylinder arrangement direction 27, that is, in a right end part of the front cylinder head 22R when facing forward in the travel direction of the vehicle.

Figure 12:
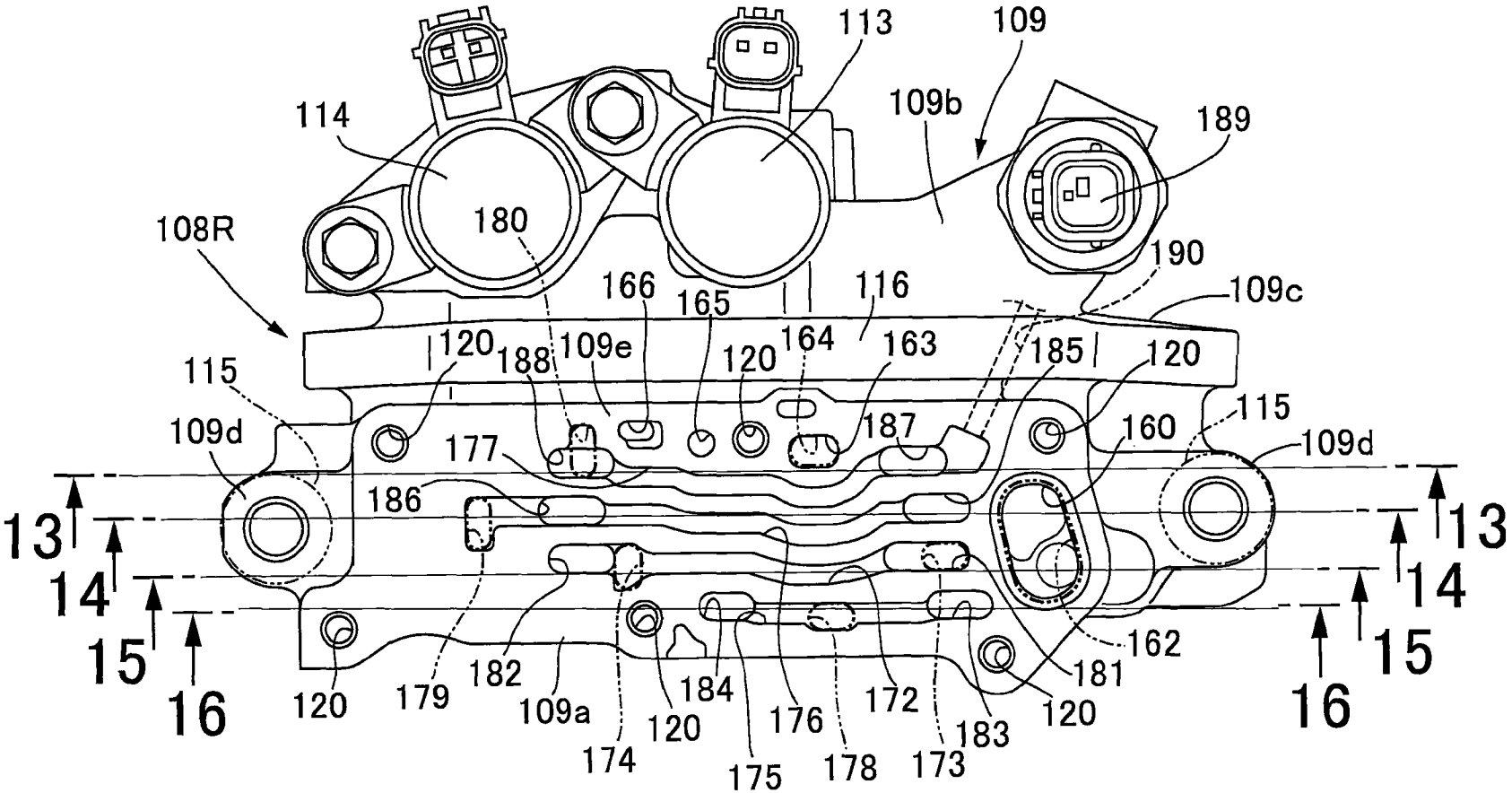
FIG. 12 is a plan view in which a valve body of rear bank side hydraulic pressure control means is omitted. (first embodiment)
Figure 13:
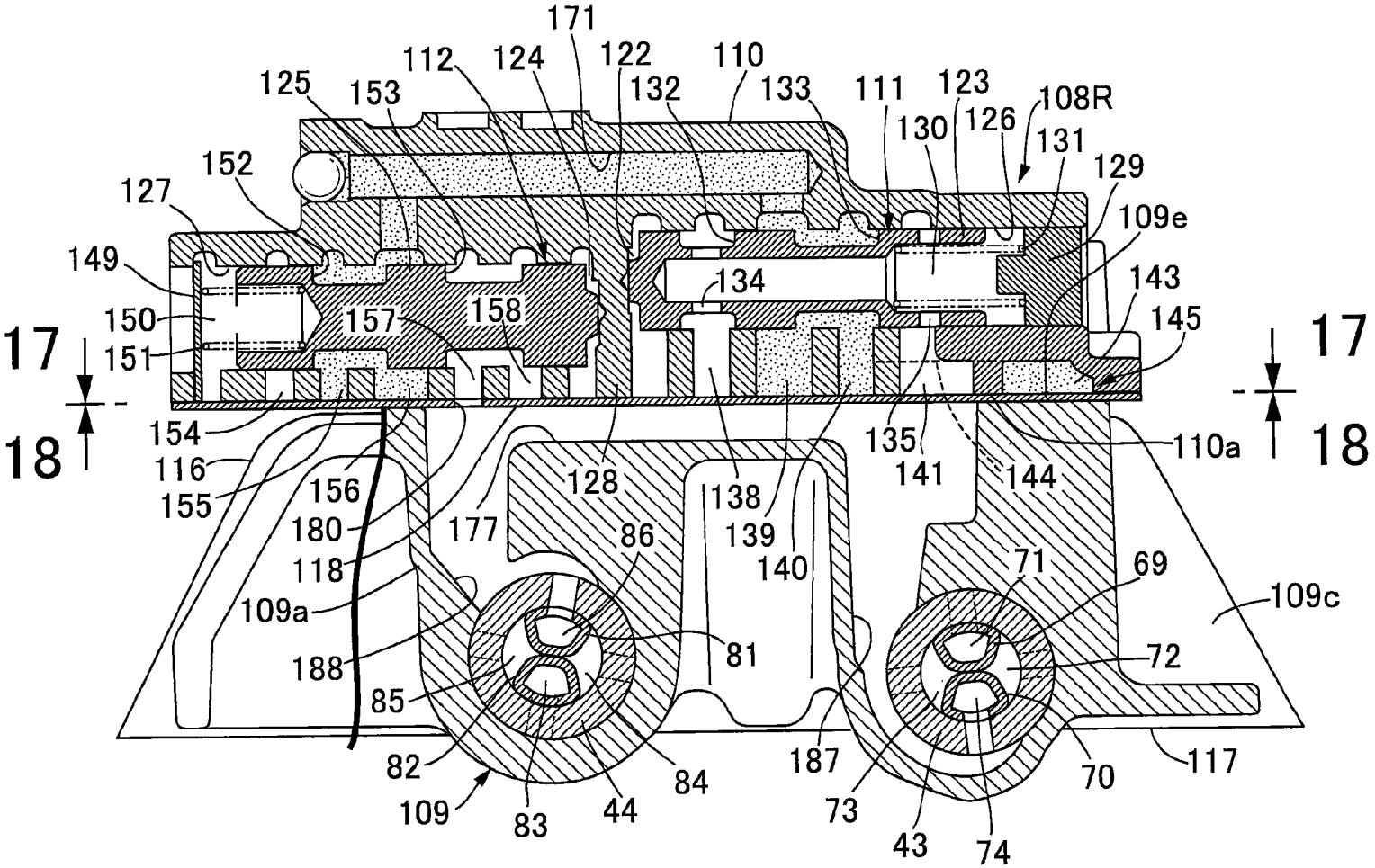
FIG. 13 is a sectional view along line 13-13 in FIG. 12. (first embodiment)
Figure 14:
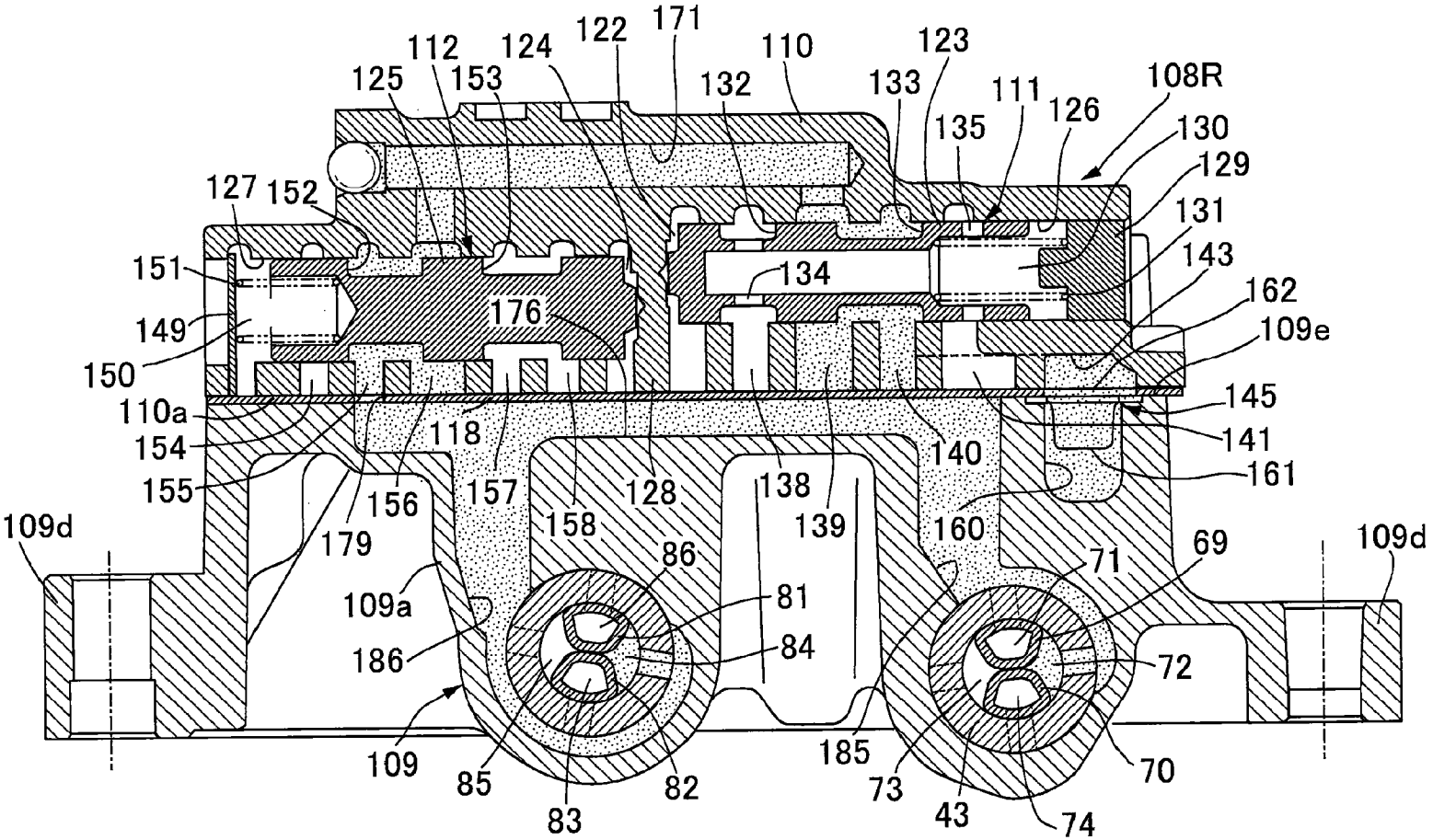
FIG. 14 is a sectional view along line 14-14 in FIG. 12. (first embodiment)
Figure 15:
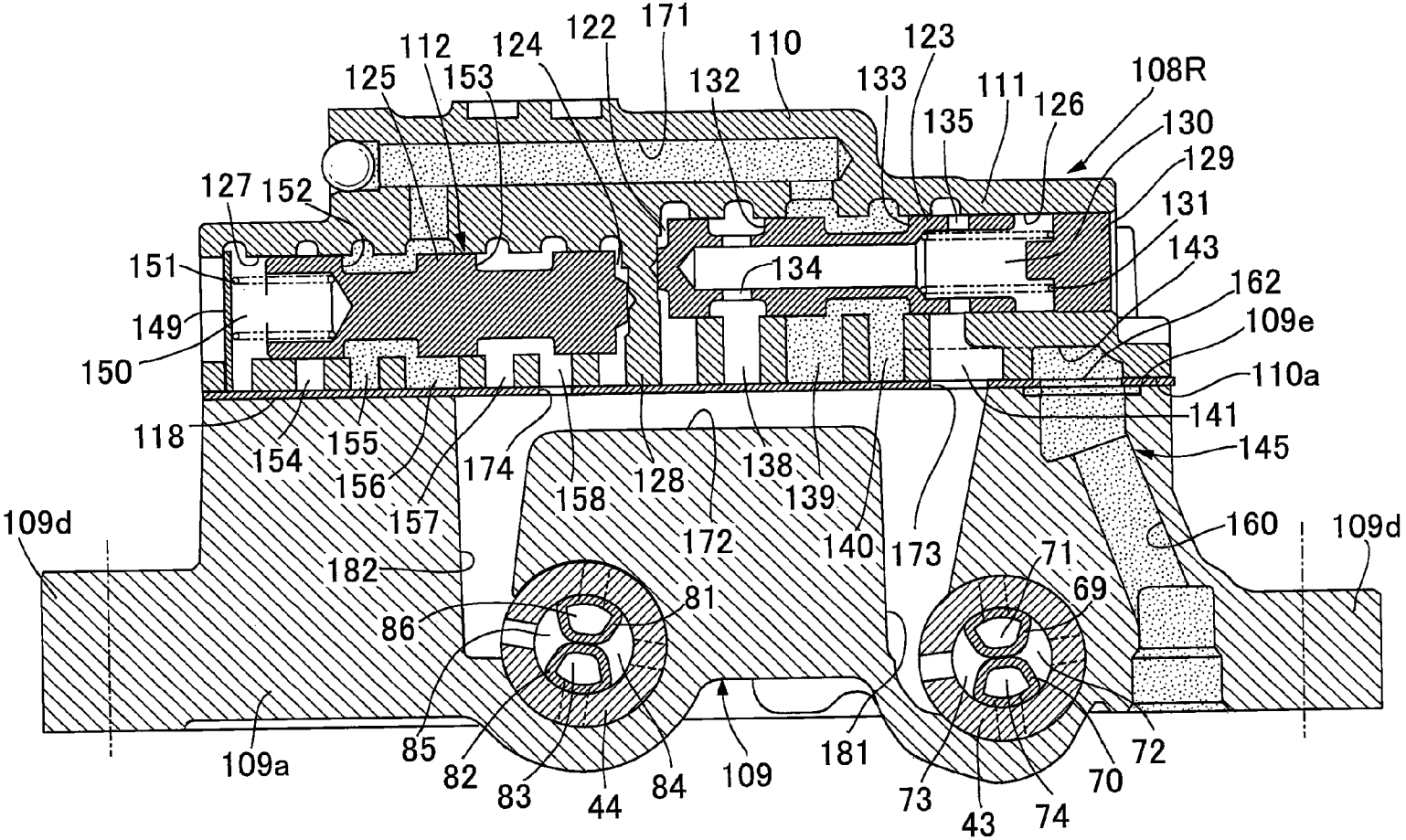
FIG. 15 is a sectional view along line 15-15 in FIG. 12. (first embodiment)
Figure 16:
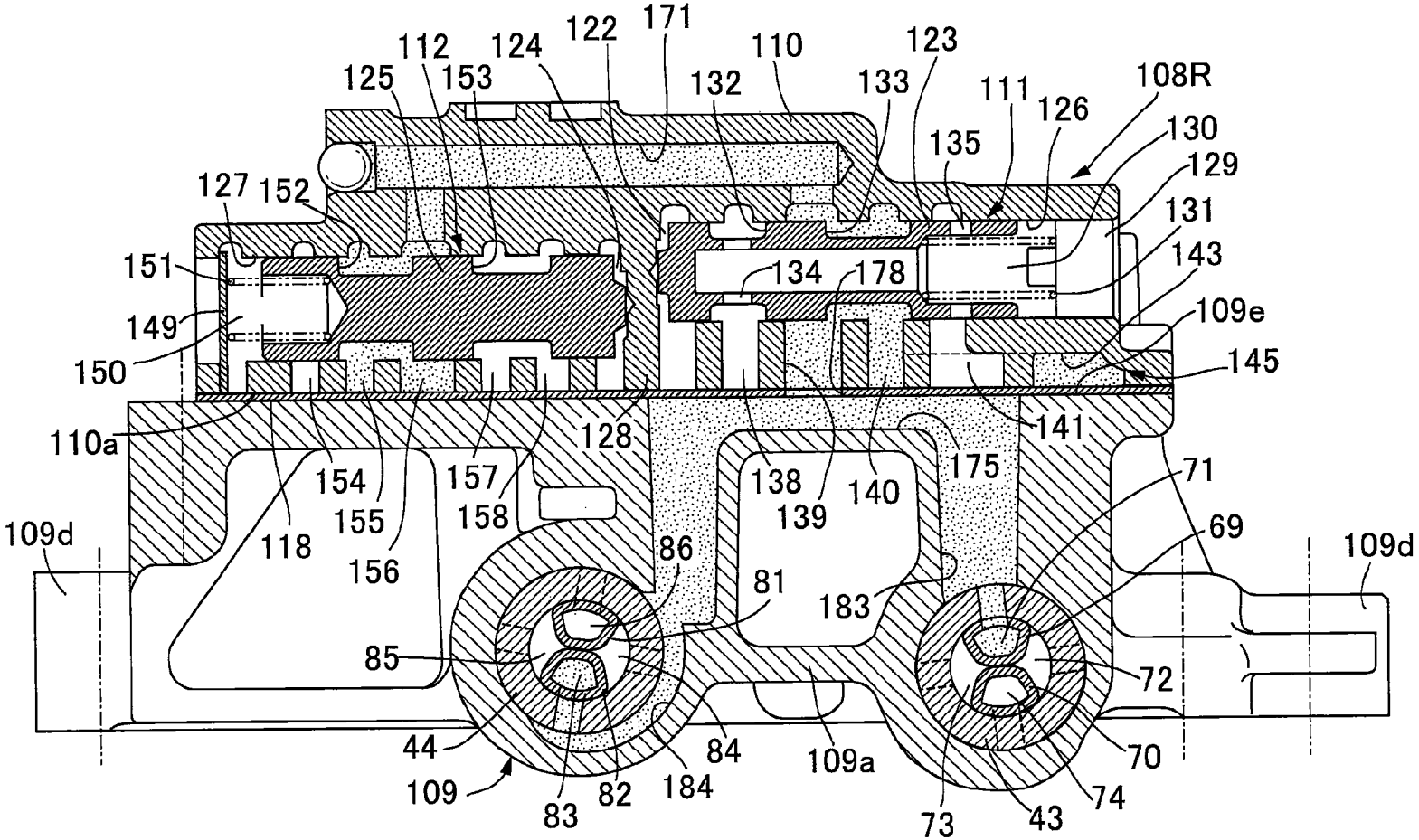
FIG. 16 is a sectional view along line 16-16 in FIG. 12. (first embodiment)
Figure 17:
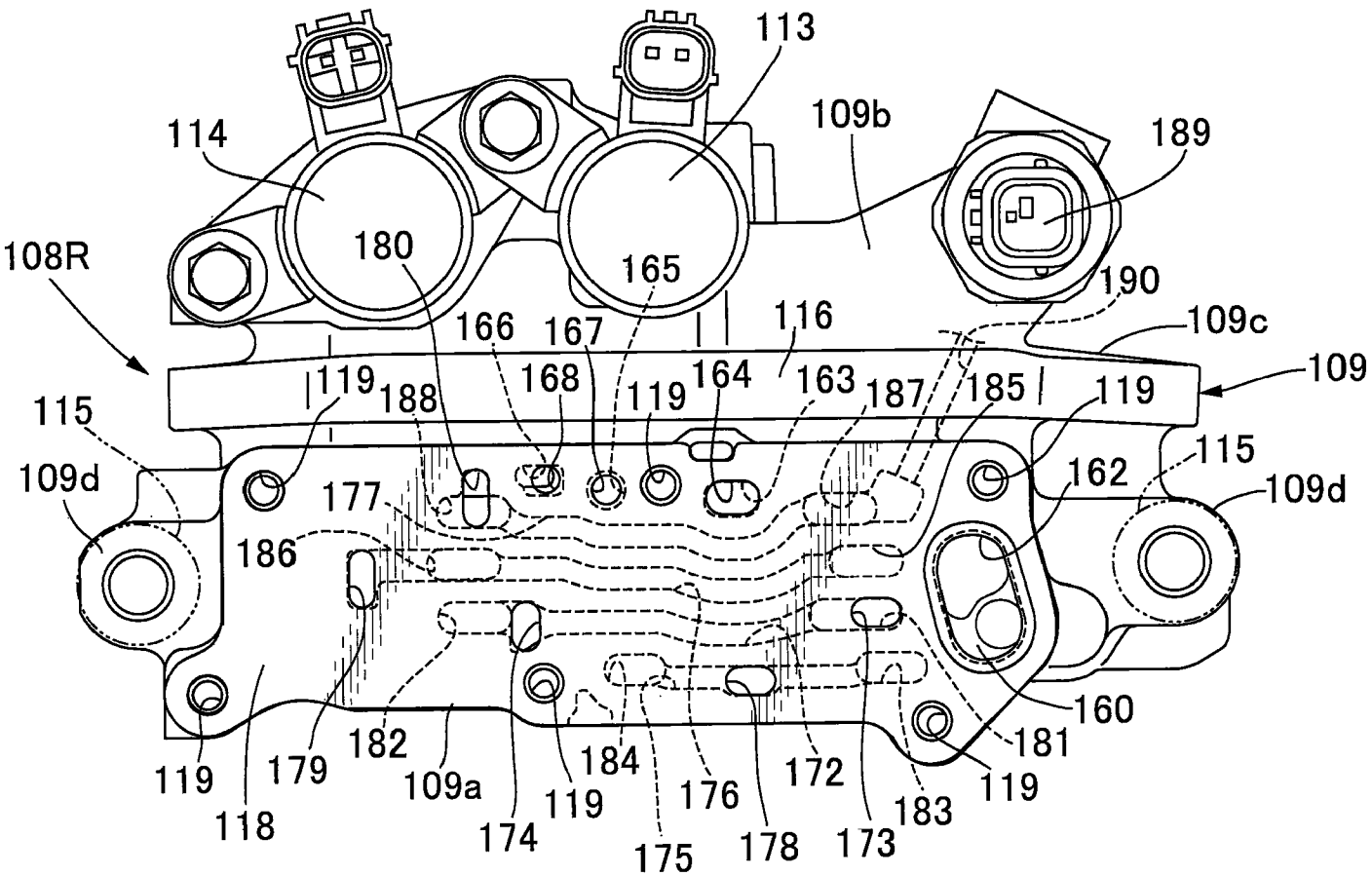
FIG. 17 is a view from arrowed line 17-17 in FIG. 13. (first embodiment)

In FIG. 12 and FIG. 13, the hydraulic pressure control means 108R on the rear bank BR side is arranged in accordance with the present invention, the hydraulic pressure control means 108R being formed from a holder 109 mounted on an upper face of the left end part of the rear cylinder head 22R, a valve body 110 provided so as to be connected to the holder 109, first and second spool valves 111 and 112 disposed in the valve body 110, and first and second electromagnetic open/close valves 113 and 114 disposed on the holder 109 so as to control the operation of the first and second spool valves 111 and 112.

The holder 109 is formed by integrally joining by means of a connection portion 109*c* a housed portion 109*a* housed between the rear cylinder head 22R and the rear head cover 23R secured to the rear cylinder head 22R, and a projecting portion 109*b* projecting outside the rear cylinder head 22R and the rear head cover 23R.

Mounting arm portions 109*d* and 109*d* extending in the fore-and-aft direction so as to be perpendicular to the cylinder arrangement direction 27 are integrally provided with the housed portion 109*a*, and these mounting arm portions 109*d* are secured to the upper face of the rear cylinder head 22R by bolts 115 and 115. Furthermore, a flat joining face 109*e* parallel to joining faces of the mounting arm portions 109*d* by which they are joined to the rear cylinder head 22R are formed on the upper face of the housed portion 109*a* between the two mounting arm portions 109*d*.

The connection portion 109*c* is formed so that the cross-sectional shape in a direction perpendicular to the cylinder arrangement direction 27 is trapezoidal, and a seal face 116 with the rear head cover 23R is formed on an upper face of the connection portion 109*c*. The rear head cover 23R is joined to the rear cylinder head 22R via a rubber gasket between the rear head cover 23R and the seal face 116 and between the rear head cover 23R and the rear cylinder head 22R. Furthermore, a seal face 117 with the rear cylinder head 22R is formed on a lower face of the connection portion 109*c*, and this seal face 117 is coated with a liquid gasket so as to be disposed between the seal face 117 and the rear cylinder head 22R.

Referring in addition to FIG. 14 to FIG. 18, a flat joining face 110*a* is formed on a face, on the housed portion 109*a* of the holder 109 side, of the valve body 110, which is a separate body from the holder 109, the joining face 110*a* being parallel to the joining face of the holder 109 by which it is joined to the rear cylinder head 22R. The joining face 110*a* of the valve body 110 is joined to an upper face of the housed portion 109*a* of the holder 109, that is, the joining face 109*e*, so that a flat plate-shaped separate plate 118 is disposed between the joining face 110*a* and the joining face 109*e*, and the joining faces 109*e* and 110*a* and the separate plate 118 are formed so as to have substantially identical external shapes.

A plurality of, for example six, insertion holes 119 are provided in the valve body 110 and the separate plate 118 so as to be disposed at intervals in outer peripheral parts of the joining face 110*a* and the separate plate 118, and threaded holes 120 corresponding to these insertion holes 119 are provided in the housed portion 109*a* of the holder 109. By screwing and tightening bolts 121 inserted into the insertion holes 119 (see FIG. 2) into the threaded holes 120 the valve body 110 is secured to the housed portion 109*a* of the holder 109 with the separate plate 118 disposed between the valve body 110 and the joining face 109*e* of the housed portion 109*a* of the holder 109.

That is, the housed portion 109*a* of the holder 109 is mounted on the upper face of the rear cylinder head 22R by securing, by means of the bolts 115 and 115, the mounting arm portions 109*d* and 109*d*, which are integrally connected to the housed portion 109*a* and extend to opposite sides, whereas the joining face 110*a* of the valve body 110 is disposed between two positions at which the housed portion 109*a* is secured to the rear cylinder head 22R by the bolts 115.

The first spool valve 111 is formed by slidably housing a first spool valve body 123 in the valve body 110, the first spool valve body 123 having one end part facing a first pilot hydraulic chamber 122, and the second spool valve 112 is formed by slidably housing a second spool valve body 125 in the valve body 110, the second spool valve body 125 having one end part facing a second pilot hydraulic chamber 124.

Moreover, the first spool valve body 123 of the first spool valve 111 and the second spool valve body 125 of the second spool valve 112 are slidably housed in the valve body 110 so as to have axes parallel to each other in a direction that is perpendicular to the cylinder arrangement direction 27, and the first and second spool valve bodies 123 and 125 are slidably housed in the valve body 110 so that the first and second pilot hydraulic chambers 122 and 124, which end parts of the first and second spool valve bodies 123 and 125 respectively face, are close to each other and the directions of movement when hydraulic pressure is applied to the two pilot hydraulic chambers 122 and 124 are opposite to each other.

That is, bored in the valve body 110 so as to extend in the fore-and-aft direction in a direction perpendicular to the cylinder arrangement direction 27 are a bottomed first housing hole 126 having its outer end opening toward the front in the travel direction of the vehicle and a bottomed second housing hole 127 having its outer end opening toward the rear in the travel direction of the vehicle, and provided in the valve body 110 is a dividing wall 128 disposed between the first and second housing holes 126 and 127 so as to close the inner ends of the first and second housing holes 126 and 127.

The first spool valve body 123 is slidably housed in the first housing hole 126 so as to form the first pilot hydraulic chamber 122 between itself and the dividing wall 128, a first spring chamber 130 is formed between the first spool valve body 123 and a blocking member 129 fixed to the valve body 110 so as to block the outer end of the first housing hole 126, and a spring 131 that spring-biases the first spool valve body 123 to the side on which the volume of the first pilot hydraulic chamber 122 is reduced is housed in the first spring chamber 130 and provided in a compressed state between the first spool valve body 123 and the blocking member 129.

The first spool valve body 123 is formed in a bottomed cylindrical shape that is open on the first spring chamber 130 side, first and second annular recesses 132 and 133 are provided on the outer periphery of the first spool valve body 123 in sequence from the first pilot hydraulic chamber 122 side with an interval therebetween in the axial direction, and a plurality of first communication holes 134 providing communication between the first annular recess 132 and the first spring chamber 130 and a plurality of second communication holes 135 opening on the outer periphery of the first spool valve body 123 further on the first spring chamber 130 side than the second annular recess 133 are provided in the first spool valve body 123.

Furthermore, a first release port 138, a first output port 139, a first input port 140, and a second output port 141 are provided in the valve body 110 in sequence from the first pilot hydraulic chamber 122 side at intervals in the axial direction so that the inner ends thereof open on the inner periphery of the first housing hole 126 and the outer ends thereof open on the joining face 110*a* of the valve body 110, and a drain hole 142 (see FIG. 2 and FIG. 18) having its inner end communicating with the first release port 138 and its outer end opening on an upper face of the valve body 110 is provided in the valve body 110.

Figure 18:
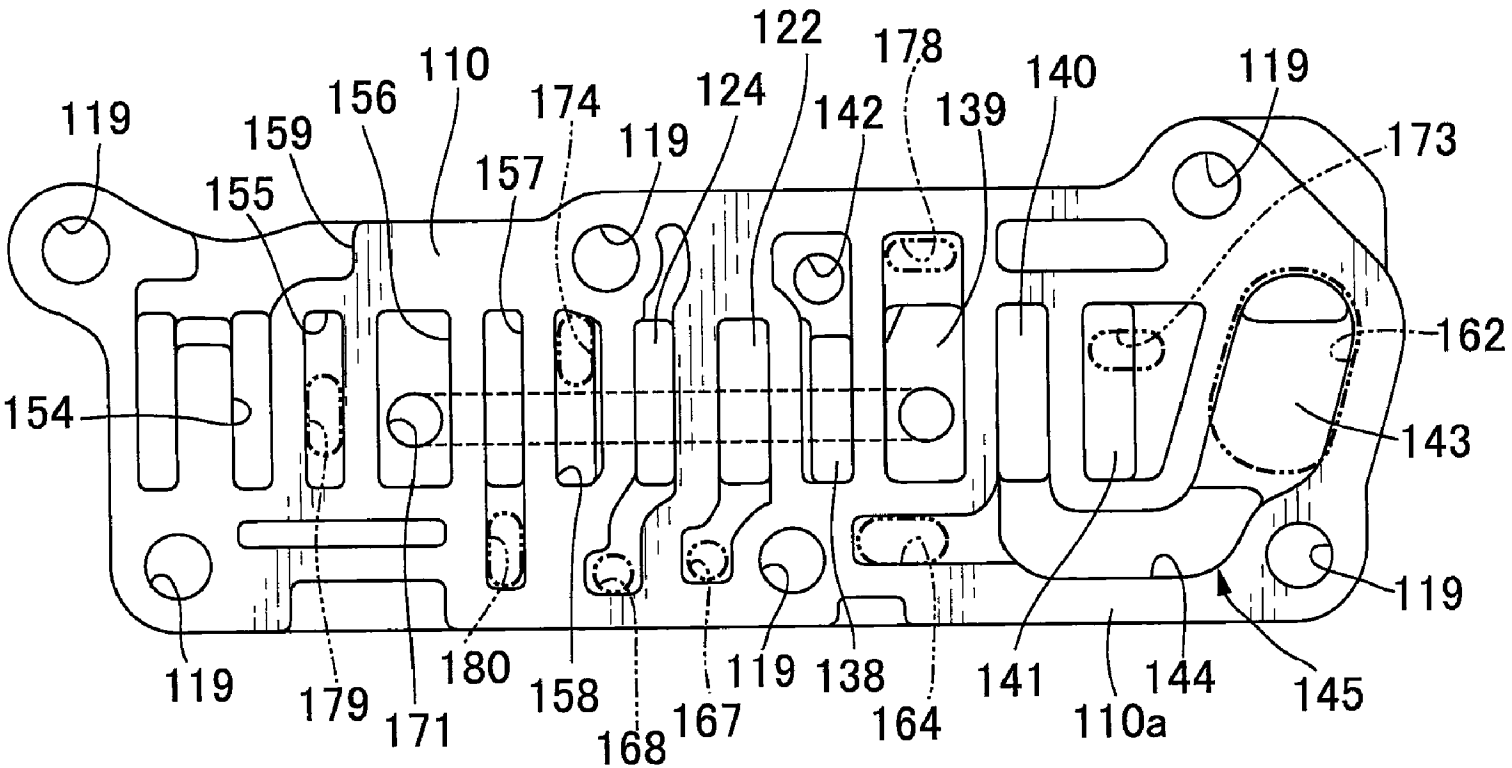
FIG. 18 is a view of the valve body from arrowed line 18-18 in FIG. 13. (first embodiment)

Provided on the joining face 110*a* of the valve body 110 are, as shown in FIG. 18, a recess 143 sandwiching the second output port 141 between itself and the first input port 140, and a communication groove 144 providing a connection between the first input port 140 and the recess 143 while bypassing the second output port 141. The recess 143 and the communication groove 144 form part of a source pressure oil passage 145, and hydraulic pressure from the source pressure oil passage 145 is applied to the first input port 140.

In an OFF state of the first spool valve 111 in which no hydraulic pressure is applied to the first pilot hydraulic chamber 122, as shown in FIG. 13 to FIG. 16, the first spool valve body 123 is in a position at which it provides communication between the first input port 140 and the first output port 139 via the second annular recess 133, and the first input port 140 and the second output port 141 are cut off In this case, the second output port 141 communicates with the first spring chamber 130 via the second communication holes 135, the first spring chamber 130 communicates with the drain hole 142 via the first communication holes 134 and the first release port 138, and hydraulic pressure of the second output port 141 is released.

Furthermore, in an ON state of the first spool valve 111 in which hydraulic pressure is applied to the first pilot hydraulic chamber 122, the first spool valve body 123 moves to the side on which the volume of the first spring chamber 130 is reduced, the first input port 140 communicates with the second output port 141 via the second annular recess 133, and the first output port 139 is cut off from the first input port 140. In this case, since the first annular recess 132 attains a state in which it provides communication between the first release port 138 and the first output port 139, and the first output port 139 communicates with the drain hole 142 via the first release port 138, the hydraulic pressure of the first output port 139 is released, and the second communication holes 135 are closed by the inner periphery of the first housing hole 126.

The second spool valve body 125 of the second spool valve 112 is slidably housed in the second housing hole 127 so as to form the second pilot hydraulic chamber 124 between itself and the dividing wall 128, a second spring chamber 150 is formed between the second spool valve body 125 and a blocking plate 149 fixed to the valve body 110 so as to block the outer end of the second housing hole 127, and a spring 151 that spring-biases the second spool valve body 125 to the side on which the volume of the second pilot hydraulic chamber 124 is reduced is housed in the second spring chamber 150 and provided in a compressed state between the second spool valve body 125 and the blocking plate 149.

Third and fourth annular recesses 152 and 153 are provided on the outer periphery of the second spool valve body 125 in sequence from the second spring chamber 150 side with an interval therebetween in the axial direction. Furthermore, a second release port 154, a third output port 155, a second input port 156, a fourth output port 157, and a third input port 158 having inner ends thereof opening on the inner periphery of the second housing hole 127 and outer ends thereof opening on the joining face 110*a* of the valve body 110 are provided in the valve body 110 in sequence from the second spring chamber 150 side at intervals in the axial direction, and a drain recess 159 that communicates with the second spring chamber 150 and the second release port 154 (see FIG. 18) is provided in the valve body 110 so as to open on an inside side wall of the valve body 110.

In an OFF state of the second spool valve 112 in which no hydraulic pressure is applied to the second pilot hydraulic chamber 124, as shown in FIG. 13 to FIG. 16, the second spool valve body 125 is in a position at which the second input port 156 and the third output port 155 communicate via the third annular recess 152 and the third input port 158 and the fourth output port 157 communicate via the fourth annular recess 153, and in this state communication between the second input port 156 and the fourth output port 157 and between the third output port 155 and the second release port 154 is cut off.

Furthermore, in an ON state of the second spool valve 112 in which hydraulic pressure is applied to the second pilot hydraulic chamber 124, the second spool valve body 125 moves to the side on which the volume of the second spring chamber 150 reduces, the second input port 156 communicates with the fourth output port 157 via the fourth annular recess 153, the third output port 155 communicates with the second release port 154 via the third annular recess 152, and communication between the third input port 158 and the fourth output port 157 is cut off.

An oil pump (not illustrated) driven by power transmitted from the crankshaft 28 is provided on the crankcase 24 (see FIG. 1), hydraulic pressure discharged from the oil pump is guided from the crankcase 24 to the rear cylinder head 22R via the rear cylinder block 21R, the holder 109 is provided with a hydraulic pressure supply passage 160 into which hydraulic pressure is guided from the rear cylinder head 22R, the hydraulic pressure supply passage 160 opening on the joining face 109*e*, which is an upper face of the housed portion 109*a*, and an oil filter 161 is provided at the open end of the hydraulic pressure supply passage 160 so as to be held between the separate plate 118 and the holder 109.

Moreover, the separate plate 118 is provided with a first communication hole 162 providing communication between the hydraulic pressure supply passage 160 and the recess 143, and the hydraulic pressure supply passage 160, the first communication hole 162, the recess 143, and the communication groove 144 form the source pressure oil passage 145 for guiding source pressure from the oil pump.

The holder 109 is provided with a pilot input oil passage 163 for guiding hydraulic pressure from the source pressure oil passage 145 to the first and second electromagnetic open/close valves 113 and 114 side so as to open on the joining face 109*e*, and the separate plate 118 is provided with a second communication hole 164 for providing communication between the communication groove 144 of the source pressure oil passage 145 and the pilot input oil passage 163.

Furthermore, the holder 109 is provided with a first pilot output oil passage 165, which has the first electromagnetic open/close valve 113 disposed between itself and the pilot input oil passage 163, so as to open on the joining face 109*e* at a position corresponding to the first pilot hydraulic chamber 122 of the first spool valve 111, and a second pilot output oil passage 166, which has the second electromagnetic open/close valve 114 disposed between itself and the pilot input oil passage 163, so as to open on the joining face 109*e* at a position corresponding to the second pilot hydraulic chamber 124 of the second spool valve 112, and the separate plate 18 is provided with a third communication hole 167 for providing communication between the first pilot output oil passage 165 and the first pilot hydraulic chamber 122 and a fourth communication hole 168 for providing communication between the second pilot output oil passage 166 and the second pilot hydraulic chamber 124.

The first spool valve 111 provides communication between the first input port 140 and the first output port 139 and cuts off communication between the first input port 140 and the second output port 141 in its OFF state, and provides communication between the first input port 140 and the second output port 141 and cuts off communication between the first input port 141 and the first output port 139 in its ON state, the first output port 139 communicating with the second input port 156 of the second spool valve 112 via a first oil passage 171 and the second output port 141 communicating with the third input port 158 of the second spool valve 112 via a second oil passage 172, which is an oil passage that is independent from the first oil passage 171. That is, the first spool valve 111 operates so as to apply hydraulic pressure of the source pressure oil passage 145 by alternatively switching between the first and second oil passages 171 and 172, which are independent from each other, and the second spool valve 112 is connected to the first spool valve 111 via the first and second oil passages 171 and 172.

The first oil passage 171 is formed in the valve body 110 so as to provide communication between the first output port 139 of the first spool valve 111 and the second input port 156 of the second spool valve 112. Furthermore, the second oil passage 172 is formed in the holder 109 so as to provide communication between the second output port 141 of the first spool valve 111 and the third input port 158 of the second spool valve 112, and the second oil passage 172 is formed in a groove shape on the joining face 109*e* of the holder 109 by which it is joined to the valve body 110. The separate plate 118 is provided with a fifth communication hole 173 for providing communication between the second output port 141 of the first spool valve 111 and one end of the second oil passage 172, and a sixth communication hole 174 for providing communication between the third input port 158 of the second spool valve 112 and the other end of the second oil passage 172.

End parts of the intake side and exhaust side rocker shafts 43 and 44 of the valve-operating device 41R are fitted into the housed portion 109*a* of the holder 109, and the second oil passage 172 is formed so as to extend lengthwise in a direction that is substantially perpendicular to the axes of the intake side and exhaust side rocker shafts 43 and 44.

Furthermore, formed on the joining face 109*e* of the holder 109 by which it is joined to the valve body 110 are not only the second oil passage 172 but also groove-shaped third, fourth, and fifth oil passages 175, 176, and 177, which extend substantially parallel to the second oil passage 172 at intervals in the axial direction of the intake side and exhaust side rocker shafts 43 and 44, and provided in the separate plate 118 are a seventh communication hole 178 for providing communication between the first output port 139 of the first spool valve 111 and the third oil passage 175, an eighth communication hole 179 for providing communication between the third output port 155 of the second spool valve 112 and the fourth oil passage 176, and a ninth communication hole 180 for providing communication between the fourth output port 157 of the second spool valve 112 and the fifth oil passage 177.

An intake side first communication passage 181 for providing communication between one end side of the second oil passage 172 and the first cut-off side oil passage 73 within the intake side rocker shaft 43 is provided in the holder 109 and the intake side rocker shaft 43, an exhaust side first communication passage 182 for providing communication between the other end side of the second oil passage 172 and the third cut-off side oil passage 85 within the exhaust side rocker shaft 44 is provided in the holder 109 and the exhaust side rocker shaft 44, an intake side second communication passage 183 for providing communication between one end side of the third oil passage 175 and the first operation side oil passage 71 within the intake side rocker shaft 43 is provided in the holder 109, the intake side rocker shaft 43, and the dividing member 69, an exhaust side second communication passage 184 for providing communication between the other end side of the third oil passage 175 and the third operation side oil passage 83 within the exhaust side rocker shaft 44 is provided in the holder 109, the exhaust side rocker shaft 44, and the dividing member 82, an intake side third communication passage 185 for providing communication between one end side of the fourth oil passage 176 and the second operation side oil passage 72 within the intake side rocker shaft 43 is provided in the holder 109 and the intake side rocker shaft 43, an exhaust side third communication passage 186 for providing communication between the other end side of the fourth oil passage 176 and the fourth operation side oil passage 84 within the exhaust side rocker shaft 44 is provided in the holder 109 and the exhaust side rocker shaft 44, an intake side fourth communication passage 187 for providing communication between one end side of the fifth oil passage 177 and the second cut-off side oil passage 74 within the intake side rocker shaft 43 is provided in the holder 109, the intake side rocker shaft 43, and the dividing member 70, and an exhaust side fourth communication passage 188 for providing communication between the other end side of the fifth oil passage 177 and the fourth cut-off side oil passage 86 within the exhaust side rocker shaft 44 is provided in the holder 109, the exhaust side rocker shaft 44, and the dividing member 81.

Furthermore, a detection passage 190 communicating with the fifth oil passage 177 is provided in the holder 109, and a hydraulic pressure detector 189 for detecting the hydraulic pressure of the detection passage 190 is mounted on the holder 109.

Referring to FIG. 3, the hydraulic pressure control means 108F on the front bank BF side is formed from a holder 191 mounted on an upper face of the front cylinder head 22F, a valve body 192 mounted on the holder 191, a spool valve (not illustrated) disposed in the valve body 192, and a third electromagnetic open/close valve 194 disposed on the holder 191 in order to control operation of the spool valve.

The holder 191 is secured to an upper face of an end part on the right-hand side in the front cylinder head 22F when facing forward in the travel direction of the vehicle, a seal face 195 with the front head cover 23F is formed on an upper face of the inner end of the holder 191 along the cylinder arrangement direction 27, and this seal face 195 is coated with liquid gasket so as to be disposed between the seal face 195 and the front head cover 23F.

End parts of the intake side rocker shaft 92 and the exhaust side rocker shaft 93 are fitted into the holder 191, the spool valve disposed in the valve body 192 is arranged so that it alternatively switches, according to opening and closing operations of the third electromagnetic open/close valve 194, between a state in which hydraulic pressure from the source pressure oil passage, which is not illustrated, is applied to the fifth operation side oil passage 101 within the intake side rocker shaft 92 and the sixth operation side oil passage 103 within the exhaust side rocker shaft 93, and a state in which it is applied to the fifth cut-off side oil passage 102 within the intake side rocker shaft 92 and the sixth cut-off side oil passage 104 within the exhaust side rocker shaft 93.

Moreover, mounted on the holder 191 is a hydraulic pressure detector 196 for detecting the hydraulic pressure applied to the fifth and sixth cut-off side oil passages 102 and 104.

The operation of this embodiment is now explained. The hydraulic pressure control means 108R on the rear bank BR side is formed from the holder 109 mounted on an upper face of the rear cylinder head 22R, the valve body 110 provided so as to be connected to the holder 109, the first and second spool valves 111 and 112 disposed in the valve body 110, and the first and second electromagnetic open/close valves 113 and 114 disposed on the holder 109 in order to control the operation of the first and second spool valves 111 and 112, the holder 109 is formed by integrally connecting via the connection portion 109*c* the housed portion 109*a* housed between the rear head cover 23R and the rear cylinder head 22R and the projecting portion 109*b* projecting outside the rear cylinder head 22R and the rear head cover 23R and having the first and second electromagnetic open/close valves 113 and 114 mounted thereon, the seal faces 116 and 117 with the rear head cover 23R and the rear cylinder head 22R are formed on the connection portion 109*c*, and the valve body 110 is provided so as to be connected to the housed portion 109*a* of the holder 109 so as to be housed between the rear head cover 23R and the rear cylinder head 22R.

It is therefore possible to directly return drain oil from the valve body 110 into the rear head cover 23R via the drain hole 142 and the drain recess 159, and since it is only oil passages connected to the first and second electromagnetic open/close valves 113 and 114 mounted on the holder 109, that is, the pilot input oil passage 163, the first pilot output oil passage 165, and the second pilot output oil passage 166, that are provided in the connection portion 109*c* of the holder 109, the cross-sectional area of the holder 109 in a portion where the seal faces 116 and 117 are formed, that is, the cross-sectional area of the connection portion 109*c*, can be set relatively small, thereby enhancing the sealing properties of the seal faces 116 and 117.

Furthermore, since the housed portion 109*a* of the holder 109 is secured by the bolts 115 and 115 to the rear cylinder head 22R at two mutually spaced positions, and the joining face 110*a* of the valve body 110, which is formed as a separate body from the holder 109, by which it is joined to the housed portion 109*a* is set parallel to the joining face of the holder 109 by which it is joined to the rear cylinder head 22R and is disposed between the two positions where the housed portion 109*a* is secured to the rear cylinder head 22R, the valve body 110 is mounted on the housed portion 109*a* of the holder 109 in a portion where the mounting rigidity is high, thus enhancing the mounting rigidity of the valve body 110.

Furthermore, since the hydraulic pressure control means 108R has the first spool valve 111, which is formed by slidably housing the first spool valve body 123 in the valve body 110 so that it operates so as to alternatively switch the application of hydraulic pressure of the source pressure oil passage 145 to the mutually independent first and second oil passages 171 and 172, and the second spool valve 112, which is formed by slidably housing the second spool valve body 125 in the valve body 110 and is connected to the first spool valve 111 via the first and second oil passages 171 and 172, the first oil passage 171 is formed in the valve body 110, and the second oil passage 172 is formed in the holder 109, by forming the first and second oil passages 171 and 172 so as to be divided between the valve body 110 and the holder 109, which are separate members from each other, it becomes possible to reduce the size by reducing the space necessary for forming the first and second oil passages 171 and 172 while avoiding interference between the first and second oil passages 171 and 172, and the ease of machining of the first and second oil passages 171 and 172 can be enhanced.

Moreover, since the second oil passage 172 is formed in the joining face 109*e* of the holder 109 by which it is joined to the valve body 110, formation of the second oil passage 172 is easy.

Furthermore, since the first and second spool valve bodies 123 and 125 with which the first and second spool valves 111 and 112 respectively are equipped are slidably housed in the valve body 110 so as to have axes parallel to each other in a direction perpendicular to the cylinder arrangement direction 27, it is possible to reduce the size of the valve body 110 in the cylinder arrangement direction 27.

Moreover, since the first and second spool valve bodies 123 and 125 are slidably housed in the valve body 110 so that the first and second pilot hydraulic chambers 122 and 124, which end parts of the spool valve bodies 123 and 125 respectively individually face, are close to each other and the directions of movement thereof when hydraulic pressure is applied to the first and second pilot hydraulic chambers 122 and 124 are opposite to each other, by making the first and second pilot hydraulic chambers 122 and 124 close to each other it is possible to make the first and second pilot output oil passages 165 and 166 communicating with the two pilot hydraulic chambers 122 and 124 close to each other, make the arrangement of the two pilot output oil passages 165 and 166 compact, and reduce any loss in hydraulic pressure in the pilot output oil passages 165 and 166 to a low level.

Moreover, the first and second spool valve bodies 123 and 125 of the first and second spool valves 111 and 112 disposed in the valve body 110 are slidably inserted into the first and second housing holes 126 and 127 from the outer end sides so as to form the first and second pilot hydraulic chambers 122 and 124 between themselves and the dividing wall 128, the first and second housing holes 126 and 127 being provided in the valve body 111 so that the inner ends are closed by the dividing wall 128 disposed therebetween and the outer ends open in opposite directions from each other, the springs 131 and 151 are housed on the outer end sides of the first and second housing holes 126 and 127, and the outer end open parts of the first and second housing holes 126 and 127 may be closed by the blocking member 129 and the blocking plate 149, thereby enhancing the ease of assembling the first and second spool valves 111 and 112.

An embodiment of the present invention is explained above, but the present invention is not limited to the above-mentioned embodiment and may be modified in a variety of ways as long as the modifications do not depart from the present invention described in Claims.

For example, in the above-mentioned embodiment the intake side valve operation mode changing mechanism 63 and the exhaust side valve operation mode changing mechanism 75 are formed so as to change the operation mode of the intake valves VI and the exhaust valves VE of the plurality of cylinders C1 to C3 between the opening/closing state and the valve-closed cut-off state, but the valve operation mode changing mechanism may be arranged so as to change the amount of valve-opening lift and the valve-opening angle of an intake valve VI and an exhaust valve VE.

The invention claimed is:

1. A valve operation control system for an internal combustion engine comprising a hydraulic valve operation mode changing mechanism (63, 75) for switching the operation mode of an engine valve (VI, VE) openably and closably disposed in a cylinder head (22R), and hydraulic pressure control means (108R) for controlling hydraulic pressure that is applied to the valve operation mode changing mechanism (63, 75), the hydraulic pressure control means (108R) comprising a holder (109) mounted on the cylinder head (22R), a spool valve (111, 112) formed by slidably housing a spool valve body (123, 125) in a valve body (110) provided so as to be connected to the holder (109), the spool valve body (123, 125) having one end part facing a pilot hydraulic chamber (122, 124), and an electromagnetic open/close valve (113, 114) for controlling hydraulic pressure of the pilot hydraulic chamber (122, 124), characterized in that the holder (109) is formed by integrally connecting a housed portion (109*a*) and a projecting portion (109*b*) by means of a connection portion (109*c*), the housed portion (109*a*) being housed between the cylinder head (22R) and a head cover (23R) secured to the cylinder head (22R), the projecting portion (109*b*) projecting outside the cylinder head (22R) and the head cover (23R) and having the electromagnetic open/close valve (113, 114) mounted thereon, a seal face (116, 117) between the head cover (23R) and the cylinder head (22R) is formed on the connection portion (109*c*), and the valve body (110) is provided so as to be connected to the housed portion (109*a*) while being housed between the head cover (23R) and the cylinder head (22R).

2. The valve operation control system for an internal combustion engine according to claim 1, wherein the housed portion (109*a*) of the holder (109) is secured to the cylinder head (22R) at two mutually spaced positions, a joining face (110*a*) of the valve body (110) by which the valve body (110) is joined to the housed portion (109*a*) is set so as to be parallel to a joining face of the holder (109) by which the holder (109) is joined to the cylinder head (22R), the valve body (110) being formed as a separate body from the holder (109), and the joining face (110*a*) is disposed between the two positions via which the housed portion (109*a*) is secured to the cylinder head (22R).

3. The valve operation control system for an internal combustion engine according to claim 1 or 2, wherein the spool valve bodies (123, 125) of a pair of the spool valves (111, 112) are slidably housed in the valve body (110) so as to have mutually parallel axes in a direction perpendicular to a cylinder arrangement direction (27) of a plurality of cylinders (C1, C2, C3) disposed in-line.

4. The valve operation control system for an internal combustion engine according to claim 3, wherein the spool valve bodies (123, 125) of the two spool valves (111, 112) are slidably housed in the valve body (110) so that the pilot hydraulic chambers (122, 124), which end parts of the spool valve bodies (123, 125) respectively face, are close to each other and moving directions when hydraulic pressure is applied to the two pilot hydraulic chambers (122, 124) are opposite to each other.

5. A valve operation control system for an internal combustion engine comprising: hydraulic valve operation mode changing mechanisms (63, 75) disposed for each of a plurality of cylinders (C1, C2, C3) in order to switch the operation mode of an engine valve (VI, VE) openably and closably disposed in a cylinder head (22R) of an engine main body (20) having the cylinders (C1 to C3); and hydraulic pressure control means (108R) having a holder (109) mounted on the cylinder head (22R) and a spool valve (111, 112) that is formed by slidably housing a spool valve body (123, 125) in a valve body (110) mounted on the holder (109) and that controls hydraulic pressure applied to the valve operation mode changing mechanisms (63, 75); characterized in that the hydraulic pressure control means (108R) has a first spool valve (111) formed by slidably housing a first spool valve body (123) in the valve body (110) to operate so as to apply hydraulic pressure of a source pressure oil passage (145) by alternatively switching mutually independent first and second oil passages (171, 172), and a second spool valve (112) that is formed by slidably housing a second spool valve body (125) in the valve body (110) and is connected to the first spool valve (111) via the first and second oil passages (171, 172), the first oil passage (171) being formed in the valve body (110) and the second oil passage (172) being formed in the holder (109).

6. The valve operation control system for an internal combustion engine according to claim 5, wherein the second oil passage (172) is formed on a joining face (109*e*) of the holder (109) by which the holder (109) is joined to the valve body (110).

7. The valve operation control system for an internal combustion engine according to claim 5 or 6, wherein the first and second spool valve bodies (123, 125) are slidably housed in the valve body (110) so as to have mutually parallel axes in a direction perpendicular to a cylinder arrangement direction (27) of the plurality of cylinders (C1 to C3), which are disposed in-line.

8. The valve operation control system for an internal combustion engine according to claim 7, wherein the first and second spool valve bodies (123, 125) are slidably housed in the valve body (110) so that pilot hydraulic chambers (122, 124), which end parts of the spool valve bodies (123, 125) respectively face, are close to each other and moving directions when hydraulic pressure is applied to the two pilot hydraulic chambers (122, 124) are opposite to each other.

* * * * *